US010344486B2

(12) United States Patent
Coote et al.

(10) Patent No.: US 10,344,486 B2
(45) Date of Patent: Jul. 9, 2019

(54) SYSTEM, APPARATUS AND METHOD FOR USE IN CONSTRUCTION TO ASSIST IN SUPPORTING SUSPENDED CONCRETE

(71) Applicants: Eamus Paul Coote, Jacobs Well (AU); Keith Anthony Callanan, Brookwater (AU)

(72) Inventors: Eamus Paul Coote, Jacobs Well (AU); Keith Anthony Callanan, Brookwater (AU)

( * ) Notice: Subject to any disclaimer, the term of this patent is extended or adjusted under 35 U.S.C. 154(b) by 0 days.

(21) Appl. No.: 15/783,598

(22) Filed: Oct. 13, 2017

(65) Prior Publication Data

US 2018/0106054 A1 Apr. 19, 2018

(30) Foreign Application Priority Data

Oct. 14, 2016 (AU) ..... 2016904174
Apr. 4, 2017 (AU) ..... 2017901229

(51) Int. Cl.
*E04G 11/48* (2006.01)
*E04G 17/14* (2006.01)

(52) U.S. Cl.
CPC ..... *E04G 11/486* (2013.01); *E04G 11/483* (2013.01); *E04G 17/14* (2013.01)

(58) Field of Classification Search
CPC ..... E04G 17/14; E04G 11/48; E04G 11/483; E04G 11/486
USPC ..... 248/351, 357
See application file for complete search history.

(56) References Cited

U.S. PATENT DOCUMENTS 2,491,246 A * 12/1949 Bloomfield ..... E05C 17/443 248/351
2,571,390 A * 10/1951 Strand ..... B62C 5/02 248/357
2,574,857 A * 11/1951 Ball ..... E21D 11/03 248/357

(Continued)

FOREIGN PATENT DOCUMENTS

| | | |
|---|---|---|
| AU | 603455 B2 | 1/1989 |
| CA | 2739414 A1 | 11/2012 |
| GB | 1594709 | 8/1981 |

OTHER PUBLICATIONS

International Search Report for International Patent Application No. PCT/AU2017/051116 dated Dec. 8, 2017, 6 pages.

*Primary Examiner* — Michael Safavi
(74) *Attorney, Agent, or Firm* — Alston & Bird LLP

(57) ABSTRACT

An apparatus for use in construction to assist in the support of suspended concrete during at least a curing phase of the concrete. The apparatus comprises a base member and a support member coupled to the base member and moveable relative to the base member between a first relative position ("first position") and a second relative position ("second position"). A biasing mechanism is operatively coupled to the support member to bias the support member toward the second position. In use, the support member is positioned to engage and support the suspended concrete and move from the first position toward the second position as the concrete cures and contracts, to maintain substantially continuous support to the concrete during at least a substantial period of the curing phase. In the preferred embodiment the apparatus is configured for use with a support prop.

21 Claims, 11 Drawing Sheets

(56) References Cited

U.S. PATENT DOCUMENTS

| | | | | | |
|---|---|---|---|---|---|
| 2,919,476 | A * | 1/1960 | Fritz | E04F 15/22 | 52/393 |
| 2,937,842 | A * | 5/1960 | Meek | E04F 21/1805 | 182/129 |
| 3,152,672 | A * | 10/1964 | Oppenhuizen | E04B 2/78 | 52/292 |
| 3,161,264 | A * | 12/1964 | Isaacson | A47B 96/1425 | 248/351 |
| 3,228,646 | A * | 1/1966 | Lane | E04G 25/065 | 248/354.3 |
| 3,333,808 | A * | 8/1967 | Du Boff | E04G 25/04 | 211/86.01 |
| 3,465,487 | A * | 9/1969 | Coste | E04B 2/7453 | 52/208 |
| 3,782,052 | A * | 1/1974 | Vetovitz | E04B 1/35 | 52/745.02 |
| 3,822,850 | A * | 7/1974 | Elias | E04G 21/3233 | 248/200.1 |
| 3,917,208 | A * | 11/1975 | Magers | E04B 2/822 | 211/105.4 |
| 4,139,324 | A * | 2/1979 | Krings | E02D 17/08 | 405/282 |
| 4,576,354 | A * | 3/1986 | Blessing, Sr. | E04F 21/1805 | 182/186.6 |
| 5,409,192 | A * | 4/1995 | Oliver | E04B 1/34352 | 248/357 |
| 5,685,112 | A * | 11/1997 | Fara | E04G 21/24 | 52/202 |
| 8,297,011 | B2 * | 10/2012 | Quick | E05C 19/003 | 248/354.3 |
| 9,663,962 | B1 * | 5/2017 | Whittemore | E04G 21/243 | |
| 2003/0089050 | A1 * | 5/2003 | Tipping | E04G 11/48 | 52/127.2 |

* cited by examiner

SYSTEM, APPARATUS AND METHOD FOR USE IN CONSTRUCTION TO ASSIST IN SUPPORTING SUSPENDED CONCRETE

CROSS REFERENCE TO RELATED APPLICATIONS

This application claims priority to Australian Provisional Patent Application No. AU2016904174, filed on Oct. 14, 2016, and Australian Provisional Patent Application No. AU2017901229, filed on Apr. 4, 2017, the contents of which applications are hereby incorporated by reference in their entirety.

FIELD OF THE INVENTION

The present invention relates to a system, apparatus and method for use in construction to provide assistive support to suspended concrete slabs.

BACKGROUND TO THE INVENTION

In construction, the process of forming elevated floors or ceilings in buildings involves pouring concrete into formwork, suspending the concrete and allowing the concrete to cure to form the floor or ceiling slabs. The formwork may be initially supported in an elevated position by any number of methods, including the use of support props. It is typically desirable to remove the formwork once the concrete hardens to a sufficient degree and continues to cure, so the formwork can be reused elsewhere. In this case, the support props are maintained in position to support the concrete for the remainder of the curing process. The support props are held tightly between the curing concrete and a supporting surface underneath (such as the floor of a lower level) during these initial stages of curing.

In most ceiling and floor constructions, reinforced, pre-stressed concrete is used. One method of pre-stressing concrete is post tensioning. This involves the positioning of tensioning tendons across the formwork (preferably in a pre-stressed manner) before concrete is poured, and then tensioning and anchoring the tendons to the periphery of the concrete once it has hardened to a sufficient degree.

Pre-stressed concrete contracts as it fully cures. As such, if the elevated concrete is supported by support props held tightly against the concrete, then as the concrete cures it will move away from the support surface of each prop. This will loosen the connection between the concrete and support prop and in most cases the contact between the support prop and concrete will be lost before the end of the curing process. Firstly, this can cause the prop to lose balance and fall. Support props are generally long, heavy members made of heavy weight steel or similar strong, rigid materials. As such, the loosening of the connection between the support prop and the concrete presents a serious safety hazard to workers and other personnel. In a typical construction site, there may be hundreds of props distributed across the floor to provide support for multiple slabs further exacerbating this safety issue. Also, the loosening of the connection also means the concrete is no longer being sufficiently supported during the entire curing process, leading to potential damage or weakening of the concrete.

Efforts have been made to alleviate these issues. However, no effective solution has been conceived or widely adopted to date. For example, one technique used in construction to reduce the safety risk is to suspend ropes between walls for catching falling props. This technique often leads to the creation of safety paths within which the workers and personnel are encouraged to walk. The process of suspending ropes can be very time consuming and laborious. Also, this method does not solve the issue of losing support during the final stages of curing and having safety zone restrictions is frustrating to workers and personnel who want to navigate freely through the site.

Another technique used involves screwing the support surface of each prop to the concrete. But this technique also comes with its own problems. As the concrete contracts the prop will be pulled up and lifted with it. This prevents the prop from falling but can damage the concrete and is a known cause for concrete cancer, for example. The process of screwing the prop to the concrete slab is also laborious and time consuming, especially when multiple props are required to support a single slab. Removing the screws afterwards can also damage the concrete. Finally, once the prop is lifted, it is no longer supporting the concrete and instead applying a load during the final stages which is in complete contradiction to the intended purpose. Sometimes, workers are required to place another support block underneath the lifted prop to maintain support, but again this is a time consuming task that cannot be performed without some delay, meaning support to the concrete slab is inconsistent and non-optimal.

It is an object of the present invention to provide an improved device and method that ameliorates at least some of the shortcomings of existing systems and methods used to support curing elevated concrete slabs in construction as described above, or to at least provide the public with a useful choice.

BRIEF SUMMARY

In one aspect the invention may broadly be said to consist of an apparatus for use in construction to assist in the support of suspended concrete during at least a curing phase of the concrete, the apparatus comprising:

a base member;

a support member coupled to the base member and moveable relative to the base member between a first relative position ("first position") and a second relative position ("second position");

a biasing mechanism operatively coupled to the support member to bias the support member toward the second position; and wherein, in situ, the support member is positioned to engage and support the suspended concrete and move from the first position toward the second position as the concrete cures and contracts to maintain substantially continuous support to the concrete during at least a substantial period of the curing phase.

Preferably the support member is linearly moveable relative to the base member between the first position and the second position.

Preferably the first position is a retracted position in which the support member is relatively proximal to the base member and the second position is an extended position in which the support member is relatively distal to the base member.

In some embodiments the biasing mechanism comprises a resilient member. The resilient member may be made from a metal or other resilient material. Preferably the resilient member is substantially stiff to provide a sufficient support force to the concrete during curing. Preferably the resilient member is a helical, compression spring.

Preferably compression of the spring causes the support member to move toward the first position and relaxation of the spring causes the support member to move toward the second position. The vice versa arrangement may be implemented in alternative embodiments.

In some embodiments the biasing mechanism comprises an electromagnetic actuator, a pneumatic actuator and/or a hydraulic actuator acting on the support member.

Preferably the support member comprises a support plate having a support surface. Preferably the support surface comprises a substantially planar envelope. The support surface may comprise indentations or grips to increase the frictional coefficient of the surface with the suspended concrete structure.

Preferably the base member is configured to couple a support prop in situ.

Preferably the base member is configured to releasably couple a support prop in situ.

Preferably the base member comprise a base plate and central shaft extending laterally from the base plate, and wherein in situ, the central shaft is accommodated with an open end of the support prop and the base plate rests upon a support plate of the open end of the support prop.

Preferably the biasing member is accommodated within a substantially hollow central shaft of the base member.

Preferably the base member is axially moveable over a central axial rod of the support member.

Preferably the biasing mechanism comprises a compression spring coupled about the central axial rod of the support member and held in compression with one end against the support member and an opposing end against the base member.

Preferably the compression spring and the central axial rod extend within an axially aligned central hollow shaft of the base member.

Preferably the apparatus further comprises a guide mechanism configured to maintain axial alignment of the support member with the base member during operation.

Preferably the support member comprises a central support plate and side plates extending laterally from the central support plate, the base member comprises a central base plate and side plates extending laterally from the central base plate, the guide mechanism comprises of a pair of guide ribs formed on either the lateral side plates of the support member or the lateral side plates of the base member and a corresponding pair of guide channels formed on the other of the lateral side plates of the support member or the lateral side plates of the base member, and wherein the guide ribs are accommodated within the guide grooves to maintain axial alignment during movement of the support member relative to the base member.

Preferably the base member further comprises one or more anchoring points or apertures and the apparatus further comprises an anchoring device, such as a chain, configured to anchor the base member to a support prop in situ via the one or more anchoring points. The anchoring points may be distributed about the periphery of the base member. The anchoring points may be anchoring apertures configured to couple either end of a chain wound about the support prop column in situ.

In another aspect the invention may broadly be said to consist of an apparatus for use in construction to assist in the support of suspended concrete during at least a curing phase of the concrete, the apparatus comprising:

a base member;

a support member coupled to the base member and moveable relative to the base member between a first relative position ("first position") and a second relative position ("second position");

an actuating mechanism operatively coupled to the support member to move the support member toward the second position during operation; and wherein, in situ, the support member is positioned to engage and support the suspended concrete and move from the first position toward the second position as the concrete cures and contracts to maintain substantially continuous contact and support to the concrete during at least a substantial period of the curing phase.

Preferably the actuating mechanism is a resilient member that is biased toward the second position, in situ. The resilient member may be a compression spring, for example. Alternatively the actuating mechanism may comprise one or more electromagnetically, pneumatically or hydraulically operated actuators.

In another aspect the invention may broadly be said to consist of a system for supporting a suspended concrete in construction during at least a curing phase of the concrete in which the concrete typically contracts, the system comprising:

a support prop having a base end and a support end; and a support apparatus coupled to the support end of the prop having:

a base member configured to couple the support end of the prop;

a support member coupled to the base member, the support member being moveable relative to the base member between a first position and second position;

a biasing mechanism operatively coupled to the support member to bias the support member toward the second position; and wherein, in situ, the support member is positioned to engage and support the suspended concrete and move from the first position toward the second position as the concrete contracts to maintain substantially continuous support of the concrete during at least a substantial period of the curing phase.

Preferably the apparatus is configured to removably couple the support prop. Alternatively the apparatus may be integral to the support prop.

In another aspect the invention may broadly be said to consist of a system for supporting a suspended concrete in construction during at least a curing phase of the concrete in which the concrete typically contracts, the system comprising:

a support prop having a base end and a support end; and a support apparatus coupled to the support end of the prop having:

a base member configured to couple the support end of the prop;

a support member coupled to the base member, the support member being moveable relative to the base member between a first position and second position;

an actuating mechanism operatively coupled to the support member to move the support member toward the second position in situ; and wherein, in situ, the support member is positioned to engage and support the suspended concrete and move from the first position toward the second position as the concrete contracts to maintain substantially continuous support of the concrete during at least a substantial period of the curing phase.

In another aspect the invention may broadly be said to consist of a support device for supporting suspended concrete in construction during at least a curing phase of the concrete in which the concrete typically contracts, the device comprising:

a longitudinal column having a base end and a support end and a main body between the base end and support end configured to span between a ground level and the elevated concrete in situ;

a support member at the support end of the column that is moveable relative to the main body of the column between a first position and second position;

a biasing mechanism operatively coupled to the support member to bias the support member toward the second position; and wherein, in situ, the support member is positioned to engage and support the suspended concrete and move from the first position toward the second position as the concrete contracts to maintain substantially continuous support of the concrete during at least a substantial period of the curing phase.

In another aspect the invention may broadly be said to consist of a support device for supporting suspended concrete in construction during at least a curing phase of the concrete in which the concrete typically contracts, the device comprising:

a longitudinal column having a base end and a support end and a main body between the base end and support end configured to span between a ground level and the elevated concrete in situ;

a support member at the support end of the column that is moveable relative to the main body of the column between a first position and second position;

an actuating mechanism operatively coupled to the support member to move the support member toward the second position in situ; and wherein, in situ, the support member is positioned to engage and support the suspended concrete and move from the first position toward the second position as the concrete contracts to maintain substantially continuous support of the concrete during at least a substantial period of the curing phase.

In another aspect the invention may broadly be said to consist of a method for supporting suspended concrete in construction during at least a curing phase of the concrete in which the concrete contracts, the method comprising the step of:

providing assistive support to the suspended concrete via a support system including a support column held between a ground level beneath the suspended concrete and the suspended concrete;

engaging a support surface of the support system with an underside of the suspended concrete opposing the ground level, the support surface being operatively moveable relative to the ground level; and operatively biasing the moveable support surface toward the underside of the concrete to maintain substantially continuous support of the concrete in situ during at least the curing phase of the concrete.

In another aspect the invention may broadly be said to consist of a method for supporting suspended concrete in construction during at least a curing phase of the concrete in which the concrete contracts, the method comprising the step of:

providing assistive support to the suspended concrete via a support system including a support column held between a ground level beneath the suspended concrete and the suspended concrete;

engaging a support surface of the support system with an underside of the suspended concrete opposing the ground level, the support surface being operatively moveable relative to the ground level; and operatively actuating the moveable support surface toward the underside of the concrete to maintain substantially continuous support of the concrete in situ during at least the curing phase of the concrete.

In another aspect, the present invention broadly consists in an apparatus for supporting suspended concrete during at least a curing phase, the apparatus comprising a biased support structure configured to support the concrete thereagainst and having at least one biasing member and at least one support surface, wherein each biasing member is configured to bias the at least one support surface toward the concrete in situ to maintain support of the concrete during the curing phase.

Preferably each support surface is moveable between a retracted position and an extended position and is biased by the associated biasing member toward the extended position.

Preferably each support surface is linearly moveable between the retracted position and the extended position.

In some embodiments the biased support structure comprises a single support surface. In alternative embodiments the biased support structure comprises two or more support surfaces.

In some embodiments the biased support structure comprises one biased support mechanism including a biasing member. In alternative embodiments the biased support structure comprises two or more biased support mechanisms, each mechanism including a biasing member. For example, the biased support structure may comprise a pair of biased support mechanisms on either side of the structure.

In some embodiments each biased support mechanism may comprise a telescoping pair of inner and outer sleeves that are configured to move relative to one another between a retracted position in which the inner and outer sleeves are substantially overlapping and an extended position in which the inner and outer sleeves are relatively less overlapping. Preferably the biasing member of each biasing mechanism is located within the telescoping pair of sleeves to enable relative movement therebetween. Preferably the pair of inner and outer sleeves are axially aligned. In some embodiments the outer sleeve is stationary and the inner sleeve is movable. In alternative embodiments the inner sleeve is stationary and the outer sleeve is movable. Preferably the inner or outer sleeve is linearly movable relative to the outer or inner sleeve, linearly along a common axis. Preferably an associated support surface is located at an end of the movable sleeve, such that the support surface is moveable between a retracted position and an extended position.

In some embodiments each biasing member may be a resilient member, such as a helical compression spring. In alternative embodiments each biasing member may comprise one or more actuators. The actuators may be electromagnetically, pneumatically or hydraulically operated for example.

In some embodiments the apparatus is configured to couple a support prop device and comprises a coupling mechanism configured to connect the apparatus to the support prop. Preferably the coupling mechanism is configured to connect the apparatus to an end of the support prop.

In some embodiments the coupling mechanism is a realeasable coupling mechanism. In alternative embodiments the coupling mechanism is a fixed coupling mechanism.

In some embodiments the coupling mechanism is configured to cooperate with an open end or sleeve of the support prop. Preferably the coupling mechanism comprises an elongate member configured to be received within the open end or sleeve of the support prop. The coupling member may be loosely or tightly received within the open end or sleeve. The coupling member is preferably removably connectable to the open end or sleeve. Alternatively or in addition the coupling mechanism may comprise a clamp, one or more fasteners, adhesive, welding, a magnetic assembly or any other suitable mechanism for connecting two members known in the art.

In some embodiments the apparatus comprises a base member. Preferably the base member comprises an abutment face having a profile that corresponds with a profile of a surface at an end of the support prop, to thereby engage the abutment face with the surface of the support prop in situ. Preferably the abutment face is substantially planar. Preferably a coupling member extends laterally from the abutment face.

In some embodiments the apparatus may be integrally formed with the support prop.

In some embodiments the base member comprises a central body portion. Preferably the central body portion comprises a cavity for receiving an end of a support prop therein. Preferably the cavity is configured to accommodate a plate at an end of the support prop.

Preferably an elongate coupling member extends laterally from the central body portion within the cavity to couple the end of the support prop. The elongate coupling member may extend past the cavity.

In some embodiments the apparatus further comprises a guiding mechanism for maintaining axial alignment of the support surface with the support prop in situ and during movement between the fully retracted and fully extended positions. The guiding mechanism may comprise an axial guide rail and a corresponding axial guide channel on either side of the apparatus. Each guide rail may form part of a support plate and each guide channel may form part of a base member.

In some embodiments the support surface comprises a substantially high frictional coefficient. The support surface may comprise high friction material applied thereto and/or one or more formations configured to increase the frictional coefficient of the surface.

In some embodiments the apparatus further comprises a mechanism for securing or anchoring the apparatus to the support prop. The apparatus may comprise one or more chains for example that can be attached to fixing points about the apparatus and tied around the support prop to secure the apparatus thereto.

In another aspect the invention may broadly be said to consist of a support prop for supporting elevated concrete during the curing stage, the support prop comprising a biased support structure configured to support the concrete thereagainst and having at least one biasing member and at least one support surface, wherein each biasing member is configure to bias the at least one support surface toward the concrete to maintain support of the concrete during the curing phase, in situ.

In another aspect the invention may broadly be said to consist of a method for supporting concrete during the curing stage comprising the steps of engaging a support surface of a support apparatus with a corresponding surface of the concrete, and applying a force to the support surface to bias the surface toward the concrete.

Preferably the step of applying a force to the support surface is applied during at least the curing phase of the concrete.

In a fourth aspect the invention broadly consists in an apparatus for assisting in the support of elevated concrete during curing, the apparatus comprising a support surface moveable between a first position and second position, wherein the support surface is biased toward the second position in situ.

Any one or more of the above embodiments or preferred features described in relation to any one of the above aspects can be combined with any one or more of the other aspects.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

Number Ranges

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the term "and/or" means "and" or "or", or both.

As used herein "(s)" following a noun means the plural and/or singular forms of the noun.

The invention consists in the foregoing and also envisages constructions of which the following gives examples only.

BRIEF DESCRIPTION OF THE FIGURES

Preferred embodiments of the invention will be described by way of example only and with reference to the drawings, in which.

DETAILED DESCRIPTION OF VARIOUS EMBODIMENTS

Figure 1:
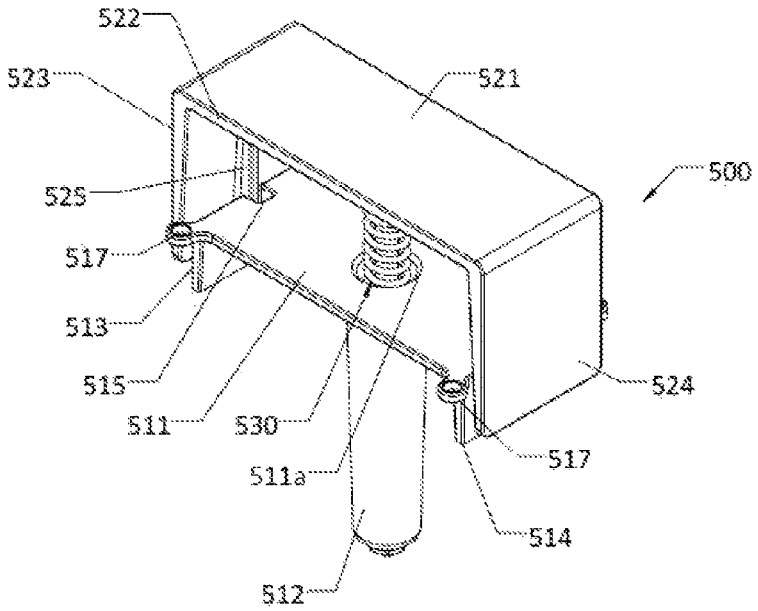
FIG. 1 is a perspective view from the top of a first preferred form support apparatus of the invention.

Referring to FIGS. 1-7, a first preferred embodiment of a concrete support apparatus 500 of the invention for use in conjunction with a support prop to provide assistive support to a suspended concrete slab or structure is shown. The apparatus comprises a support member 520 that is moveably coupled to a base member 510, such that the base member can move between a first relative position (shown in FIG. 6) and a second relative position (shown in FIG. 7). In this embodiment the first position is a retracted position in which the support member 520 is relatively proximal to the base member 510 and the second position is an extended position in which the support member 520 is relatively distal to the base member 510. The apparatus further comprises an actuating or movement mechanism 530 that enables relative movement between the support member 520 and the base member 510 and also moves the support member 520 toward the second relative position/extended position at least in situ and during operation (shown in FIG. 7). In this manner, the actuating mechanism biases the support member 520 toward the second position, in situ and during operation. In this embodiment, the actuating mechanism 530 comprise a resilient, biasing member 531, however it will be appreciated that other actuating mechanisms that bias the support member toward the second position may be used as will be described in further detail below. In this specification the phrase "biasing mechanism" is intended to mean an actuating mechanism that is configured to bias a member in a particular direction. The mechanism 530 is thus a biasing mechanism 530. The biasing mechanism may be structurally biased, such as a resilient spring or it may be controllably biased, such as in the case of an electromagnetic, pneumatic or hydraulic actuator. The extended position of the support member 520 is the neutral position of the support member in this embodiment, however this may not be the case in alternative configurations.

The support member 520 comprise a support surface 521 upon which the a suspended concrete slab or structure rests for assistive support during at least a substantial period of the curing process, and more preferably an entire period of the curing process. The apparatus 500 preferably also comprises a coupling mechanism configured to couple the support mechanism to a support prop 400 or other similar column support device. In alternative configurations, the support mechanism may be integral to the support prop or permanently fixed thereto. In this embodiment, the coupling mechanism forms part of the base member 510. However, as will be described later this is not necessarily the case in alternative configurations.

Figure 6:
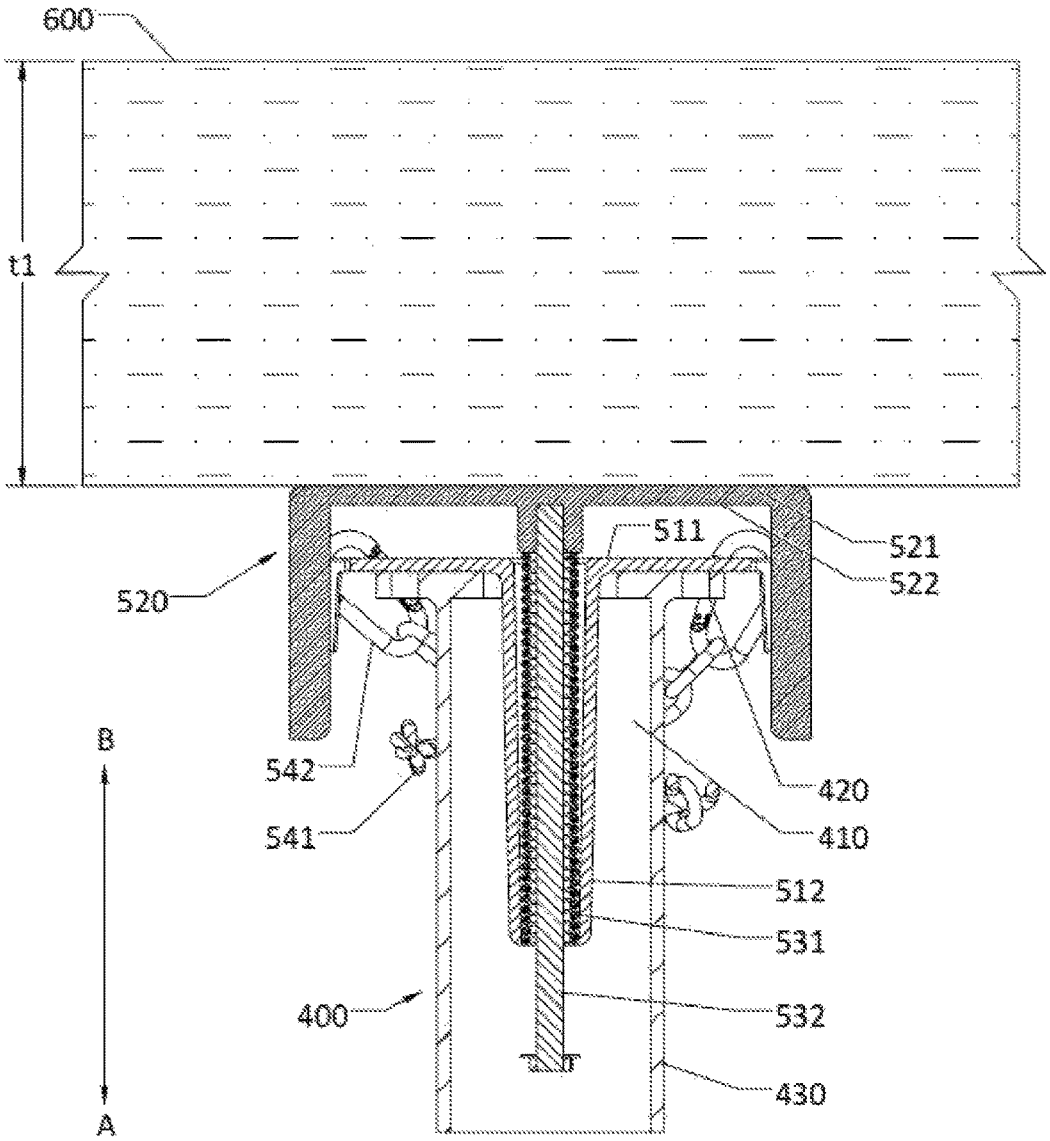
FIG. 6 is a front cross-sectional view of the support apparatus in FIG. 1 in situ and in a first supportive state, supporting a concrete slab in an initial stage of curing.
Figure 7:
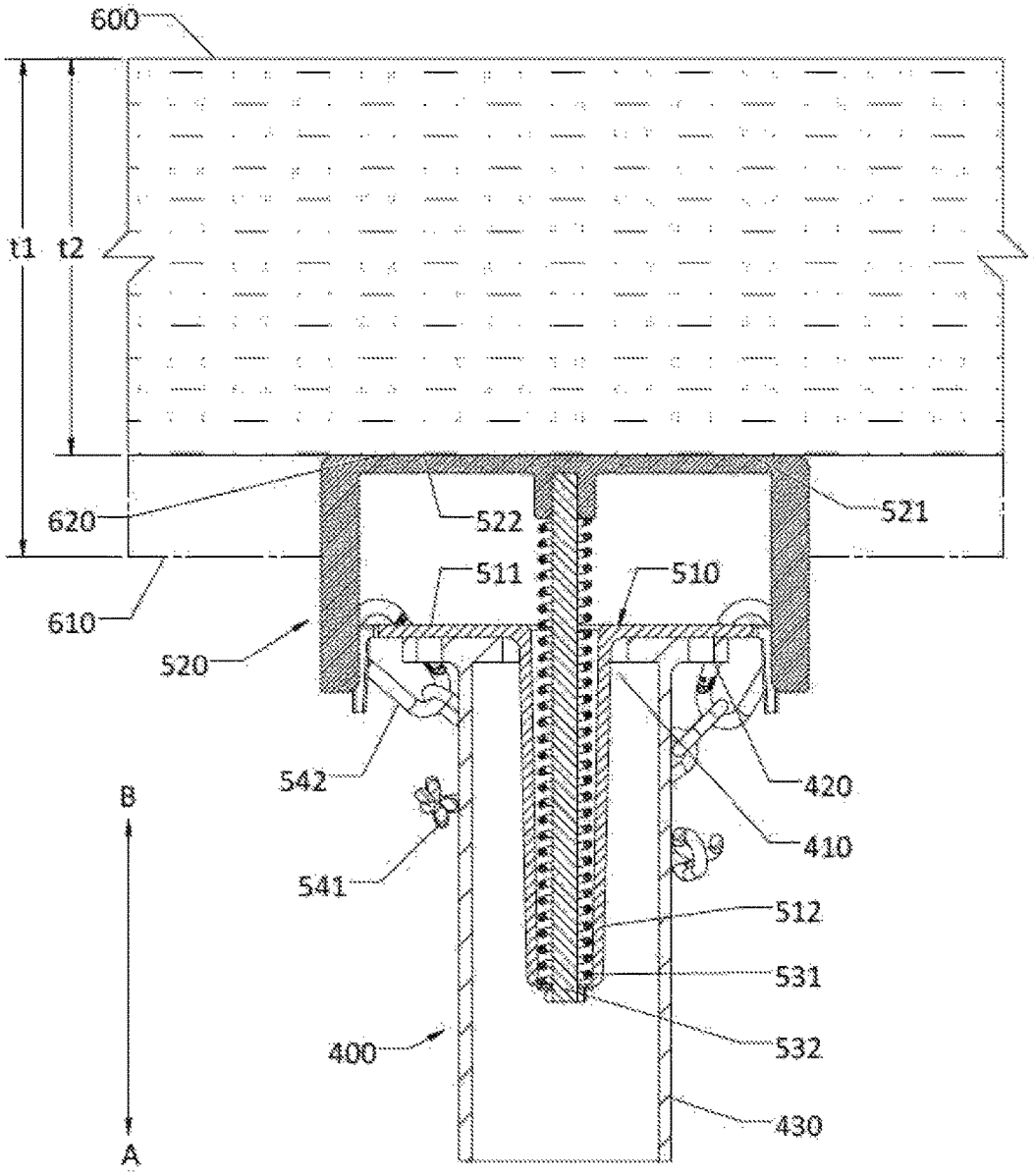
FIG. 7 is a front cross-sectional view of the support apparatus in FIG. 1 in situ and in a second supportive state, supporting a concrete slab in a final stage of curing.

As shown in FIGS. 6 and 7 when appropriately installed between a concrete slab and a support prop, the support member 520 is forced toward or into the retracted position by the concrete slab during the initial stages of curing and is later moved toward the extended position by the biasing mechanism 530 as the concrete slab hardens, contracts and moves away from the support prop 400 (i.e. the thickness of the concrete reduces from t1 to t2). The biasing mechanism 530 of the apparatus 500 is configured to ensure there is substantially consistent physical support provided by the support prop 400 and support apparatus 500 to the suspended concrete slab 600 during the curing stage. In other words, the support surface 521 maintains substantially consistent physical contact with (i.e. is maintained in a flush position relative to) the concrete slab during the entire or at least a substantial period of the curing phase by action of the biasing mechanism 530.

In this embodiment, the support surface 521 is preferably substantially planar and comprises a sufficient surface area for contact and support. For example, the contact surface may comprise a surface area that is substantially similar or larger than the surface area of the contact face of the support prop plate 420. It will be appreciated however, that the invention is not intended to be limited to such surface area sizing as shown in the third and fourth embodiments for example. In some embodiments the support surface 521 may not be planar, however this is preferred for even distribution of support.

As mentioned, the apparatus 500 comprises a mechanism or device configured to couple the apparatus 500 to an end of a support prop 400 that is intended to be located adjacent the elevated concrete in situ. In this embodiment, the coupling mechanism comprises a base plate 511 of the base member 510, lateral side walls 513 and 514 extending from either side of the base plate 511, and a central shaft or sleeve 512 extending laterally from the base plate 511 in the same direction as the side walls. The sleeve 512 is substantially hollow and open at both ends 512*a* and 512*b*. The sleeve is axially aligned with a central aperture 511*a* of plate 511. As shown in FIGS. 6 and 7, the sleeve 512 is configured to be received and accommodated within a corresponding open and hollow end 410 of the support prop 400, in situ. The sleeve 512 may be formed integrally as part of the base member 520 or otherwise formed separately and fixedly coupled to the base plate 511 about the central aperture 511*a* of the plate.

The base plate 511 and lateral side walls 513 and 514 form an open cavity or volume 515 which is configured to accommodate a substantially planar end plate 420 of the support prop 400 in situ. The plate 420 of the support prop preferably rests against the base plate 111 to substantially stabilise the apparatus 500 on and against the end 410 of the support prop 400. The lateral side walls 513 and 514 extending from either side of the central plate 111 provide a boundary for the cavity and enhance stabilisation of the apparatus on and against the support prop. The walls 513, 514 preferably comprise a length that is substantially the same or larger than the thickness of the support prop plate 420. The sleeve 512 preferably extends substantially orthogonally relative to and from the base plate 511. Similarly the lateral side walls 513 and 514 preferably extend substantially orthogonally relative to and from either side of the base plate 511. It will be appreciated that the side walls may alternatively extend about three or four sides of the base plate 511 to provide centering/stabilisation.

It is preferred that the apparatus 500 is configured to releasably couple the support prop to allow for replacement and maintenance for example. In alternative embodiments other coupling mechanisms may be employed. For example, one or more fasteners may be utilised instead or in addition to fasten the base member 510 to the corresponding end plate 420 of the support. In another alternative configuration, the apparatus may comprise a releasable clamping device which clamps against and/or about the end 410 of the support prop 400 in situ. Other releasable coupling mechanisms that would be apparent to those skilled in the may also be incorporated and are not intended to be excluded from the scope of this invention. It will be appreciated that in some embodiments, any combination of one or more coupling mechanisms as described above may be incorporated in the apparatus 500. In yet another alternative embodiment, the base member 510 may be permanently coupled via permanent fasteners or any other suitable mechanism or otherwise integrally formed via welding with the end 410 of the support 400. In this latter construction the support prop body would form the base member 510 of apparatus 500.

Figure 3:
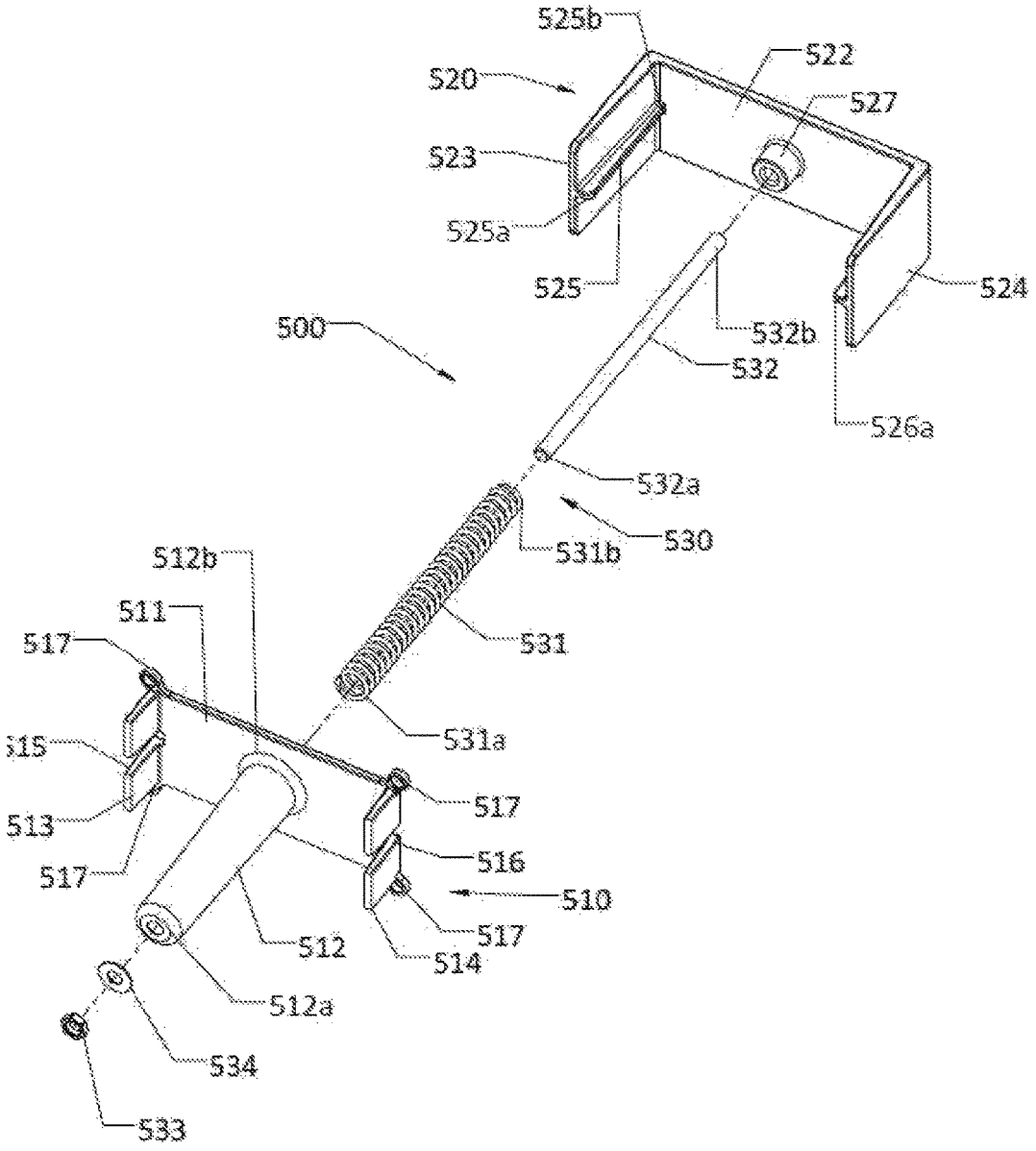
FIG. 3 is an exploded perspective view of the support apparatus of FIG. 1.
Figure 4:
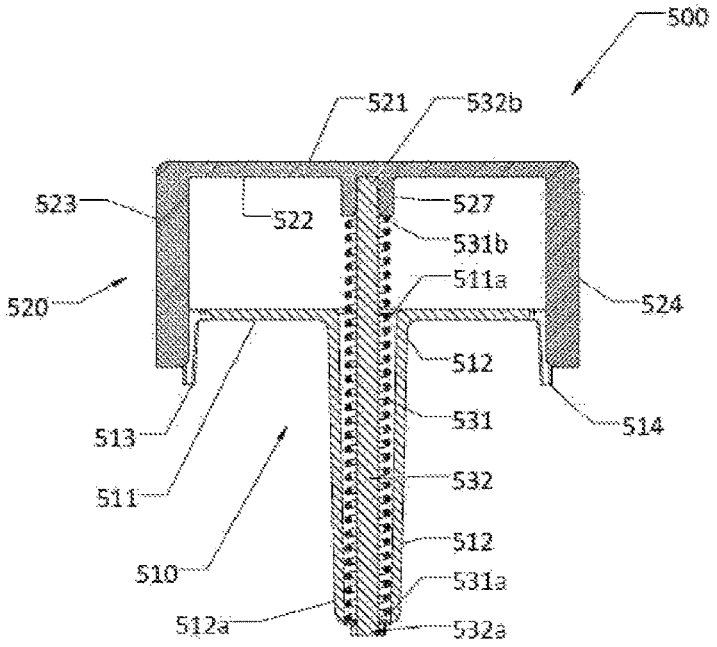
FIG. 4 is a front cross-sectional view of the support apparatus of FIG. 1 in a neutral state.

As shown in FIGS. 3 and 4, in this embodiment, the biasing mechanism 530 consists of a biasing member 531 that is resilient with a degree of stiffness sufficient to provide assistive support to suspended concrete. The resilient, biasing member 531 acts on the support member 520 to bias the surface 521 toward the fully extended position shown in FIG. 7. In this embodiment, the resilient member 531 is configured to locate within the sleeve 512 extending from the base member 510. It will be appreciated that any number of one or more resilient members may be provided and distributed about the base member to bias the support member 520 away from the base member 510. The number of resilient members may depend on the strength and/or resilience of each member and the weight that is to be supported for example.

The resilient member may be of any suitable or appropriate type for this application. In this embodiment, the resilient member 531 is in the form of a helical, compression spring. The compression spring preferably comprises substantially high stiffness and strength to enable suitable support for elevated concrete slabs used in construction, such as ceiling and/or floor slabs. As such it is preferably formed from a metal material, such as steel. As described above, in an assembled state of the apparatus, the helical compression spring 531 is located within the sleeve 512 with one end 531*a* being located against an abutment surface at end 512*a* of the sleeve and an opposing end 531*b* being located external to the sleeve 512. The end 531*b* is configured to engage and/or act on the support member 520 to bias the member 520 away from the base member 510 and toward the fully extended position shown in FIG. 7. For example, the end 531*b* may abut boss 527 of the support member 520.

Figure 2:
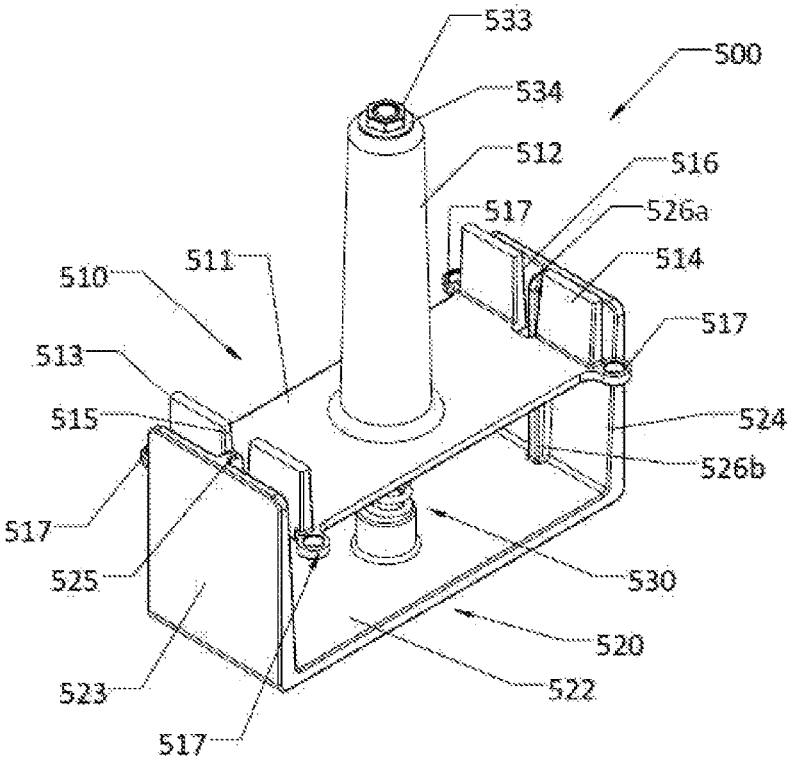
FIG. 2 is a perspective view from the bottom of the support apparatus of FIG. 1.

The biasing mechanism 530 further comprises an axial, coupling rod or shaft 532. In the assembled state, the rod 532 extends axially through the spring and the coupling sleeve 512 of the base member 510 and engages the support member 520 at one end 532*b*. The rod 532 may be received within boss 527 of support member 520 at end 532*b*. The rod 532 also extends externally of the spring and the coupling sleeve 512 such that an opposing end 532*a* is exposed. A washer 534 and corresponding fastener 533, is coupled to the exposed end 532*a* of the rod 532 to provide a limiting stop or abutment. In this manner, the washer acts as an abutment that limits the relative movement between the support member and base member, by engaging the corresponding end 512*a* of the sleeve 512 when the support member 520 moves into the fully extracted position as shown in FIGS. 1, 2 and 7. The effective length of the rod, in situ, also defines the level of pre-compression applied to the spring which is application dependent. The nut may be threadably engaged onto the end of the rod.

In this embodiment the apparatus 500 may comprises a support surface 521 having a plurality of formations (not shown) that are configured to increase the frictional coefficient of the contact between the surface 521 and suspended concrete in situ. This arrangement enhances grip and frictional engagement with concrete slab 600 in situ. The formations may take on any shape, size or pattern that is necessary to achieve the desired level of grip. For example, the formations may consists of a plurality of protrusions arranged in a repeated pattern on an exterior side of the support member. The protrusions may each be of any polygonal shape in cross-section, such as a quadrilateral shape and the like. Channels may extend between the protrusions to create an irregular planar surface. The exterior surface 521 may also be substantially non-smooth and/or sufficiently rough to increase frictional engagement. The support surface 521 may be used in any one of the apparatus embodiments described in this specification.

As shown in FIGS. 1-3, in this embodiment the support member 520 of the apparatus 500 comprises a central support plate 522 that is configured to engage the concrete slab 500 in situ, and an opposing pair of side walls 523 and 524 extending laterally from either side of the central plate 522 away from the exterior support surface 521. The lateral side walls 523 and 524 are preferably integrally formed with the central plate section 522 but these may be separately formed and fixedly coupled thereto in alternative configurations. The lateral side walls 532 and 524 preferably extend substantially orthogonally relative to the central plate section 521, however other angles are possible. In particular, the lateral side walls 523 and 524 preferably extend substantially in parallel relative to the lateral side walls 513 and 514 of the base member 510 of the apparatus 500. Also, in this embodiment the lateral side walls 523 and 524 of the support member 520 are preferably located directly adjacent and on an exterior side of the lateral side walls 512 and 513 of the base member 510. It will be appreciated that these may be located internally of the side walls 512 and 513 in alternative configurations.

The apparatus 500 comprises a guide mechanism that is configured to axially align the support member 520 with the base member 510 in situ and during operation/movement. The guide mechanism is also configured to substantially reduce or mitigate relative lateral movement between the support member 520 and the base member 510 in directions that are substantially orthogonal to the intended directions of movement A and B (shown in FIGS. 6 and 7), in situ and during operation. The support member 520 comprises a guide rail 525, 526 protruding respectively from either lateral side wall 523, 524 toward the corresponding lateral side wall 512, 513 of the base member 510. The lateral side walls 512 and 513 of the base member 510 comprise guide channels 515 and 516 configured to movably accommodate the guide rails 525 and 526 of the support member 520. The guide rails 525 and 526 and their corresponding guide channels 515 and 516 are substantially longitudinal and extend linearly in an axial direction that is substantially parallel to the axial directions of movement A-B of the apparatus 500. Each guide rail 525, 526 extends inwardly from an internal face of the respective lateral side wall 523, 524 toward the corresponding guide channel 515, 516 of the base member 510.

Each guide rail 525, 526 preferably extends from a terminal end of the respective lateral side wall 523, 524 that is distal from the central support plate 522 toward the central plate 522 and comprises of a length that is sufficient to enable movement of the support member 520 between the fully retracted and fully extended positions (i.e. the full range of motion of the apparatus 500). Each guide channel 515, 516 of the base member 510 comprises an open end at a terminal end of the respective lateral side wall 513, 514 that is distal from the central plate 511 of the base member 510. In this manner, each guide rail 525, 526 is permitted to move axially within the respective guide channel 515, 516 through the open end of the channel. In this embodiment, the guide rails 525 and 526 may provide a limit to the degree of relative displacement between the support member 520 and the base member 510, when the support member is in the extended position, by abutting with an inner surface of the central plate 511 of the base member 510. The guide rails 525 and 526 each comprise a depth that is gradually tapered. The end 525*a* and 525*b* of each rail that is distal from the central support plate 522 preferably comprises a higher depth relative to the end 525*b*, 526*b* of the rail that is proximal to the central support plate 522. However, in alternative configurations the depth of each rail may be constant along the entire length of the rail or oppositely tapered.

Each guide channel 515, 516 consists of a width that is substantially similar to the width of the received guide rail 525, 526 to thereby provide a snug fit that discourages or substantially prevents lateral movement of the guide rail within the channel along a first axis that is substantially orthogonal to the axial directions of movement A and B. Also, an interior surface of each lateral side wall 523, 524 of the support member 520 preferably extends directly adjacent and in contact with an exterior surface of the respective lateral side wall 513, 514 of the base member 510 to thereby discourage or substantially prevent lateral movement along a second axis that is substantially orthogonal to the axial directions of movement A and B and to the first axis. In this manner, during operation of the apparatus 500, as the support member 520 moves in directions A and B (shown in FIGS. 6 and 7) toward and away from the base member 510 respectively, the guide rails which are engaged with respective channels maintain axial alignment of the support member 520 with the base member 510.

It will be that many possible variations to this guiding mechanism exist. For example, the guide rails may be located on the base member and the guide channels on the support plate in some embodiments. The guide rails may extend through the central plate 511 of the base member 510. There may be multiple guide rails and corresponding channels on either side of the apparatus or there may be a single guide rail and corresponding channel. These and other variations that would be readily apparent to those skilled in the art are not intended to be excluded from the scope of this invention. The guide mechanism herein described may be used in any one of the apparatus embodiments described in this specification.

It will be appreciated that in some embodiments the apparatus 500 may alternatively or in addition consist of the centering sleeve for aiding in maintaining axial alignment between the support member and the base member as described with reference to the second embodiment.

Figure 5:
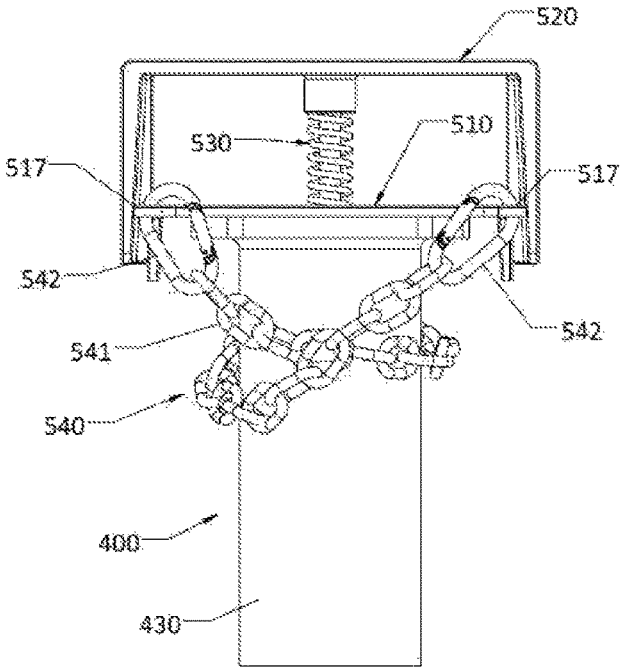
FIG. 5 is a front view of the apparatus of FIG. 1 coupled to a support prop.

Referring to FIG. 5, in this embodiment the apparatus 500 further comprises a mechanism 540 for securing or anchoring the apparatus 500 to the support prop 400 in situ. The mechanism may consist of any suitable devices and configuration and may be implemented in any one of the apparatus embodiments described in this specification. The securing or anchoring mechanism may comprise one or more chains 541 or cables or other lines that can be connected at either end to the apparatus 500 and tied around the prop support 400 to secure the device thereto. Each chain 540 may be releasably engaged with the apparatus 500 (via a carabiner 542 or other type of shackle device as is well known in the art for example) at one or both ends, or it may be fixedly engaged to the apparatus 500 at one end. The base member may comprises a plurality of fixing points or apertures 517 distributed about the periphery of the central plate 511 for releasably engaging with an end of a chain 541. Any suitable method of tying the chain about the prop support 400 may be used. For example, as shown in FIG. 5 in one method a chain may be wound about a neck 430 of the prop support 400 under the prop support head 420, and connected at either end to diagonally opposing fixing points 517, via a carabiner 542 or the like. Multiple chains 541 may be coupled to the base member 510 and the prop support 400 in this manner. It will be appreciated that one or more fixing points or apertures 517 may otherwise be located on either parts of the apparatus such as on the support member 520. This mechanism secures the apparatus 500 to the support prop 400 to avoid accidental disengagement which may result in damage to the apparatus 500 and/or injury to ground personnel. The securing or anchoring mechanism can be used in combination with any one of the embodiments herein described.

Referring now to FIGS. 6 and 7, as previously mentioned in the preferred embodiment the support member 520 is moveable between a fully retracted position in which it rests proximal to the central plate 511 of the base member 510 and the spring 531 is relatively compressed as shown in FIG. 6, and a fully extended position in which the support plate is substantially spaced and distal from the base member 510 and the spring 531 is compressed to a lesser degree as shown in FIG. 7. In the retracted position, the spring 531 is preferably substantially compressed and in the fully extended positon the spring 531 is preferably in a neutral state, or close thereof. The degree of movement, or the distance between the fully retracted and fully extended positions of the support member 520, defines the degree of concrete contraction that is supported by the apparatus. For example, the distance between the fully retracted and fully extended positions may be between approximately 50 mm-500 mm, to thereby allow for contraction in the range of 50 m-500 mm. These ranges are only exemplary to provide context and are not intended to be limiting, however, a sufficient degree of movement is necessary in all preferred implementations to maintain support during a substantial or entire duration or period of the curing phase of the concrete. It will be appreciated that the degree of movement is dependent on the type of concrete used and is hence application dependent.

Referring to FIG. 6, once assembled, the apparatus 500 can be installed on an end 410 of a support prop 400. To achieve this, the sleeve 512 is inserted into the hollow end 410 of the prop and the central plate 511 of the base member 510 is located to rest on the stabilising plate 420 of the prop 400. The prop, with the apparatus installed, can then be positioned under the concrete slab to be supported such that the slab engages the support member 520 and forces it down toward the fully retracted position. The spring 531 compresses in this position. Referring to FIG. 7, as the slab 600 cures, it contracts and moves away from the initial position 610 and away from the support prop 400. The apparatus 500, by action of the biasing spring 531 maintains support by biasing the support member 520 toward the fully extended position and toward the concrete slab, such that physical contact at location 620 between the support member 520 and the concrete slab is maintained. As such, even in the final stages of curing shown in FIG. 7, contact between the support member 520 and the concrete slab is maintained which ensures the prop remains in position, and the slab remains sufficiently supported during the entire curing phase.

In some implementations the apparatus 500 may be coupled to an end of a support prop 400 that opposes the end 410. In other words, the apparatus 500 couples the end of the support prop that opposes the elevated concrete, or the end that is configured to locate on or adjacent a floor surface underneath the elevated concrete. In this manner, the apparatus 100 couples between the floor and the support prop 400 to thereby bias the entire support prop 400 toward the elevated concrete slab and continuously move the support prop plate 420 against the concrete slab 400 during the curing phase to maintain consistent physical contact between the plate 420 and the slab 600 in situ and use.

Referring to FIGS. 8-11, a second embodiment of a concrete support apparatus 100 of the invention for use in conjunction with a support prop is shown. The apparatus comprises a support mechanism 150 having a support surface 141 that is biased toward an extracted position (shown in FIGS. 8 and 11) via a biasing mechanism or device. The apparatus 100 preferably also comprises a coupling mechanism 160 configured to couple the support mechanism to a support prop 400. In alternative configurations, the support mechanism may be integral to the support prop or permanently fixed thereto. In this embodiment, the coupling mechanism 160 consists of a base member 110 configured to couple a support prop 400, and the biased support mechanism 150 consists of a support member 140 (in the form of a plate) with a support surface 141 and a biasing member 121 operatively coupled to the support surface 141 to bias the support surface 141 away from the base member 110, thereby providing a continuous supporting force, opposing the base member 110 and the support prop 400, to a curing concrete slab 600 in situ.

The support member is in the form of a plate 140 and is moveably coupled relative to the base member 110 such that it can move between a first, fully retracted position (shown in FIG. 10) in which it locates on or relatively proximal to the base member 110, and a second, fully extended position (shown in FIG. 11) in which it locates away or relatively distal from the base member 110. The biasing member 121 biases the support plate toward the fully extended position and enables movement of the support plate 140 relative to the base member 110 between the fully retracted position and the fully extended position. When appropriately installed between a concrete slab and a support prop, the support plate 140 is forced into the retracted position by the concrete slab during the initial stages of curing and is later moved toward the extended position by the biasing member 121 as the concrete slab hardens, contracts and moves away from the support prop. The apparatus 100 further comprises a coupling mechanism or device configured to couple the apparatus 100 to a support prop or other similar column support device 400. In this embodiment the coupling mechanism forms part of the base member 110, however as will be described later this is not necessarily the case in alternative configurations.

Figure 10:
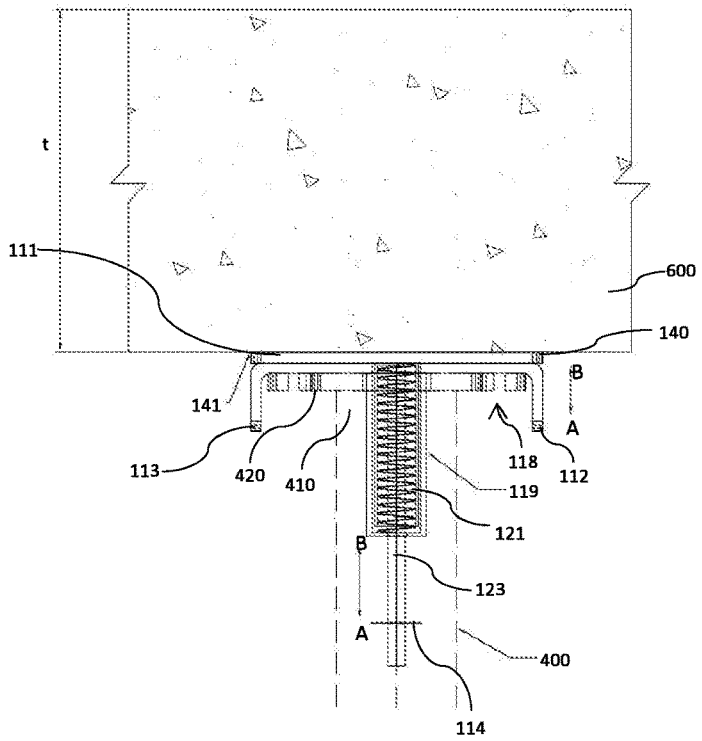
FIG. 10 is a front cross-section view of the support apparatus of FIG. 8 in use, supporting a concrete slab in an initial stage of curing.
Figure 11:
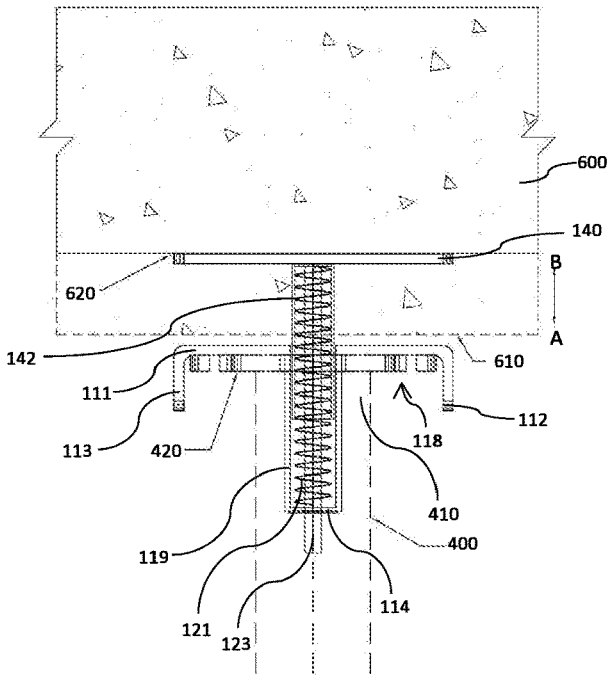
FIG. 11 is a front cross-section view of the support apparatus of FIG. 8 in use, supporting a concrete slab during or in the final stages of curing.

As shown in FIGS. 10 and 11, in situ, the assembled apparatus 100 locates between a support prop 400 and an elevated concrete slab 600 to thereby support the slab 600 on the support prop 400. The biasing member 121 of the apparatus 100 is configured to ensure there is substantially consistent physical support provided by the support prop 400 and support apparatus 100 to the elevated concrete slab 600 during the curing stage. The biasing member 121 acts on the support surface 141 to bias the surface 141 away from the support prop 400 and toward the suspended concrete slab in situ, such that as the concrete cures and contracts (such that thickness, t, reduces), the support surface 141 is maintained in a supportive state that applies a supporting force to the elevated concrete 600. In other words, the support surface 141 maintains substantially consistent physical contact with (i.e. is maintained in a flush position relative to) the concrete slab (or associated formwork) during the entire or at least a substantial period of the curing phase. In this embodiment, the support surface 141 is preferably substantially planar and comprises a sufficient surface area for contact and support. For example, the contact surface may comprise a surface area that is substantially similar or larger than the surface area of the contact face of the support prop plate 420. It will be appreciated however, that the invention is not intended to be limited to such surface area sizing as shown in the second and third embodiments for example. In some embodiments the support surface 141 may not be planar, however this is preferred for even distribution of support.

As mentioned, the apparatus 100 comprises a mechanism or device configured to couple the base member 110 to an end of a support prop 400 that is intended to be located adjacent the elevated concrete in situ. In this embodiment, the coupling mechanism comprises a coupling member 119 in the form of an elongate coupling sleeve 119 extending laterally from a central plate 111 of the base member 110. The sleeve 119 is substantially hollow and open at both ends 131 and 132. The sleeve is axially aligned with a central aperture 111*a* of plate 111. As shown in FIGS. 10 and 11, the sleeve 119 is configured to be received and accommodated within a corresponding open and hollow end 410 of the support prop 400, in situ. The sleeve 119 may be formed integrally as part of the base member 110 or otherwise formed separately and fixedly coupled to the central plate 111 about the central aperture 111*a* of the plate.

The base member 110 further comprises a central, open cavity 118 adjacent the central plate 111 which forms part of the coupling mechanism. The open cavity 118 is configured to accommodate a substantially planar end plate 420 of the support prop 400 in situ. The plate 420 of the support prop preferably rests against the central plate 111 of the base member 110 to substantially stabilise the apparatus 100 on and against the end 410 of the support prop 400. Lateral side walls 112 and 113 extending from either side of the central plate 111 provide a boundary for the cavity and enhance stabilisation of the apparatus on and against the support prop. The walls 112, 113 preferably comprise a length that is substantially the same or larger than the thickness of the support prop plate 420. The sleeve 130 preferably extends substantially orthogonally relative to and from the central plate 111. Similarly the lateral side walls 112 and 113 preferably extend substantially orthogonally relative to and from either side of the central plate 111. It will be appreciated that the side walls may alternatively extend about three or four sides of the central plate 111 to provide centering/stabilisation.

It is preferred that the apparatus 100 is configured to releasably couple the support prop to allow for replacement and maintenance for example. In alternative embodiments other coupling mechanisms may be employed. For example, one or more fasteners may be utilised instead or in addition to fasten the central plate 111 of the base member to the corresponding end plate 420 of the support. In another alternative configuration, the apparatus may comprise a releasable clamping device which clamps against and/or about the end 410 of the support prop 400 in situ. Other releasable coupling mechanisms that would be apparent to those skilled in the may also be incorporated and are not intended to be excluded from the scope of this invention. It will be appreciated that in some embodiments, any combination of one or more coupling mechanisms as described above may be incorporated in the apparatus 100. In yet another alternative embodiment, the base member 110 may be permanently coupled via rivets or any other suitable mechanism or otherwise integrally formed via welding with the end 410 of the support 400.

In this embodiment, the biasing mechanism consists of a resilient member 121 in the form of a helical spring. The resilient biasing member 121 acts on the support plate 140 to bias the surface 141 toward the fully extended position shown in FIG. 11. In this embodiment, the resilient member 121 is configured to locate within the sleeve 119 extending from the base member 110. However, it will be appreciated that any number of one or more resilient members may be provided and distributed about the base member 110 to bias the support plate 140 away from the base member 110. The number of resilient members may depend on the strength and/or resilience of each member and the weight that is to be supported for example.

The resilient member may be of any suitable or appropriate type for this application. In this embodiment, the resilient member 121 is in the form of a helical, compression spring. The compression spring preferably comprises substantially high stiffness and strength to enable suitable support for elevated concrete slabs used in construction, such as ceiling and/or floor slabs. As such it is preferably formed from a metal material, such as steel. As described above, in an assembled state of the apparatus, the helical compression spring 121 is located within the sleeve 119 with one end 121*a* being located against an abutment surface at end 119*a* of the sleeve and an opposing end 121*b* being located external to the sleeve 119. The end 121*b* is configured to engage and/or act on the support plate 140 to bias the plate 140 away from the base member 110 and toward the fully extended position shown in FIG. 4.

The apparatus may further comprise a centering sleeve 142 that is configured to locate about the end 121*b* of the compression spring 121 to minimise lateral movement of the spring, due to flexing for example, and keep the spring centred in situ and the support plate in axial alignment with the base member 110 during operation. The centering sleeve 142 is preferably axially aligned with the coupling sleeve 119 of the base member 110 in an assembled state of the apparatus. The centering sleeve 142 telescopingly engages the coupling sleeve 119 such that it can move substantially linearly in directions A and B relative to the coupling sleeve 119 along a common longitudinal axis. In turn this enables the support plate 140 to move linearly relative the base member 110 in direction A and B between the fully retracted and fully extended positions described above. In this embodiment one end 142*b* of the centering sleeve 142 is fixedly coupled to the support plate 140 and the opposing end 142*a* is moveably accommodated within the sleeve 130. For example the end 142*b* may be welded to the plate 140 such that it may be integral therewith. It will be appreciated that in alternative configurations the sleeve 119 may be telescopingly received within sleeve 142. The end 142*b* of the sleeve 142 may be open or closed. The end 142*a* is open to allow the spring to extend therethrough. In an assembled state of the apparatus, the centering sleeve 142 and the coupling sleeve 119, in combination, form an elongate cavity or cylinder within which the elongate compression spring resides. Movement of the centering sleeve 142 relative to the coupling sleeve 119 in directions A and B, thus also causes the compression spring to compress and expand respectively. The telescoping inner and outer sleeves 142 and 119 are slidable relative to one another in this embodiment, however, it will be appreciated that other bearing mechanisms or configurations may be employed for achieving relative axial movement, such as a ball bearing mechanism.

Figure 8:
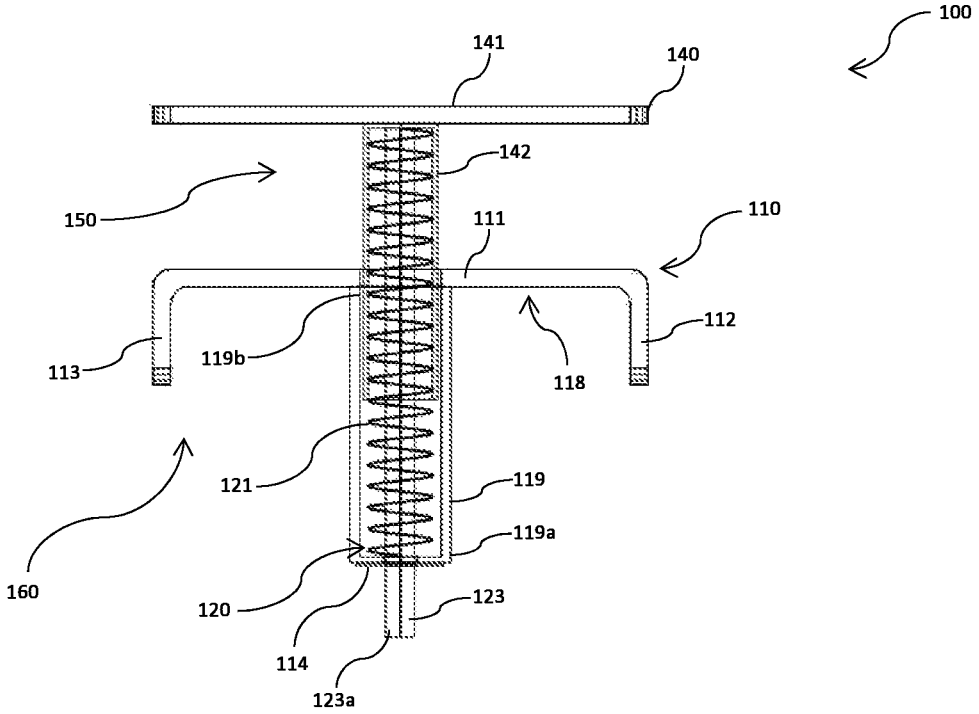
FIG. 8 is a front cross-sectional view of a second form support apparatus of the invention.
Figure 9:
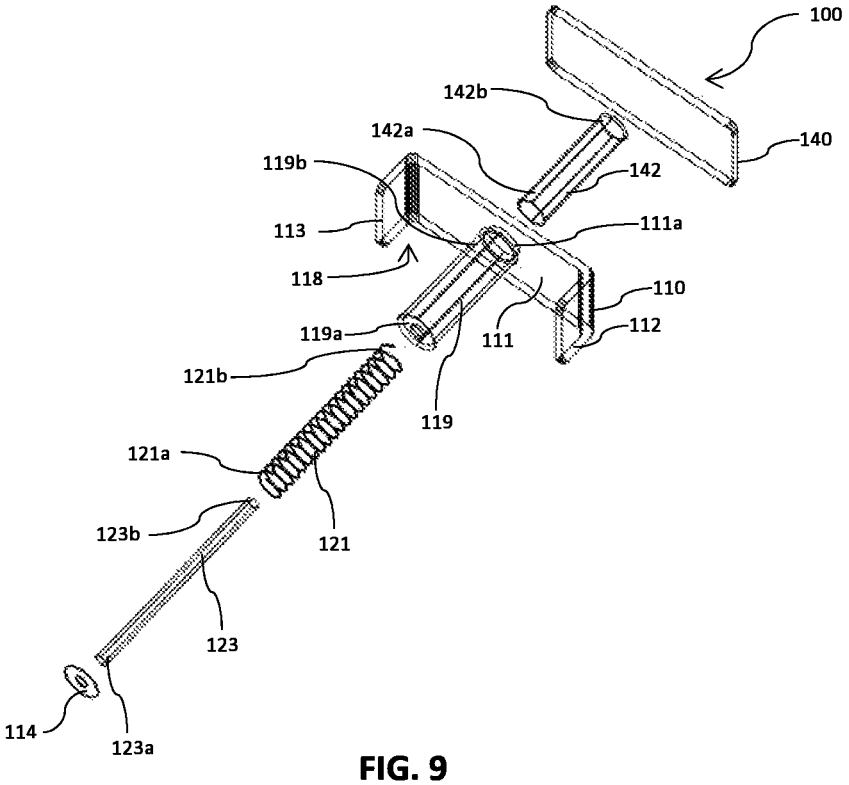
FIG. 9 is an exploded perspective view of the support apparatus of FIG. 8.

The apparatus 120 further comprises a coupling rod or shaft 123. In the assembled state, the rod 123 extends axially through the spring, the coupling sleeve 119 and the centering sleeve 142 and engages the support plate 140 at one end 123*b*. The rod 123 also extends externally of the spring and the coupling sleeve 119 such that an opposing end 123*a* is exposed. A washer 114 and corresponding fastener (not shown), is coupled to the exposed the rod 123 to provide a limiting stop or abutment. In this manner, the washer acts as an abutment that limits the relative movement between the inner and outer sleeves by engaging the corresponding end 121*a* of the outer sleeve 121 when the inner sleeve 142 and corresponding support platform 140 are moved to the fully extracted position as shown in FIGS. 8 and 11. In the retracted position the washer moves away from the lateral side walls as shown in FIG. 10. The effective length of the rod, in situ, also defines the level of pre-compression applied to the spring which is application dependent. The nut may be threadably engaged onto the end of the rod.

In this manner, the support plate 140 is maintained in a substantially parallel but spaced orientation relative to the base member 110 when the spring 121 is in a substantially relaxed and neutral state/position.

Referring to FIGS. 10 and 11, as previously mentioned in the preferred embodiment the support plate 140 is moveable between a fully retracted position in which it rests flush against (or is directly adjacent) the central plate 111 of the base member 110 and the spring 121 is relatively compressed as shown in FIG. 10, and a fully extended position in which the support plate is substantially spaced from the base member 110 and the spring 121 is relatively less compressed as shown in FIGS. 8 and 11. In the retracted position, the spring 121 is preferably substantially compressed and in the fully extended position the spring 110 is preferably in a neutral state, or close thereof. The degree of movement, or the distance between the fully retracted and fully extended positions of the support plate 140, defines the degree of concrete contraction that is supported by the apparatus. For example, the distance between the fully retracted and fully extended positions may be between approximately 50 mm-500 mm, to thereby allow for contraction in the range of 50 m-500 mm. These ranges are only exemplary to provide context and are not intended to be limiting, however, a sufficient degree of movement is necessary in all preferred implementations to maintain support during a substantial or entire duration or period of the curing phase of the concrete. It will be appreciated that the degree of movement is dependent on the type of concrete used and is hence application dependent.

Referring to FIG. 10, once assembled, the apparatus 100 can be installed on an end 410 of a support prop 400. To achieve this, the sleeve 119 is inserted into the hollow end 410 of the prop and the central plate 111 of the base member 110 is located to rest on the stabilising plate 420 of the prop 400. The prop, with the apparatus installed, can then be positioned under the concrete slab to be supported such that the slab engages the support plate 140 and forces it down toward the fully retracted position as shown in FIG. 10. The spring 121 compresses in this position and the sleeve 142 moves in direction A within the coupling sleeve 119. Referring to FIG. 11, as the slab 600 cures, it contracts and moves away from the initial position 610 and away from the support prop 400. The apparatus 100, by action of the biasing spring 121 maintains support by biasing the support plate 140 toward the fully extended position and toward the concrete slab, such that physical contact at location 620 between the support plate 140 and the concrete slab is maintained. As such, even in the final stages of curing shown in FIG. 11, contact between the support plate 140 and the concrete slab is maintained which ensures the prop remains in position, and the slab remains supported substantially during the entire curing phase.

Referring now to FIGS. 12-15, a third embodiment of a concrete support apparatus 200 of the invention will now be described. The support apparatus 200 comprises a biased supporting structure 250 and a coupling mechanism 260 as in the previous embodiment. The coupling mechanism is of a similar form to the mechanism 160 described in relation to the second embodiment, including a base member 210 having a central plate 211, a coupling cavity 218 and a coupling shaft 219. In this embodiment, however, the biased supporting structure 250 is of a different configuration to that of the first embodiment. The biased supporting structure 250 of the apparatus 200 comprises a pair of biased supporting mechanisms 220A and 220B located on either side of the base member 210. As in the first and second embodiments, each biased supporting mechanism comprises a biasing member 221A, 221B and a telescoping sleeve configuration for enabling tension/compression of the spring in situ along axial directions A and B. Each mechanism 220A, 220B extends from a lateral side wing 214A, 214B on either side of the base member 210 and comprises a biasing member 221A, 221B. In this embodiment, each biasing member is in the form of a compression spring 221A, 221B.

Each telescoping sleeve configuration comprises a stationary inner sleeve 243A, 243B and a movable outer sleeve 242A, 242B of relatively larger external diameter or width. The inner sleeves extends laterally, and preferably substantially orthogonally from a corresponding lateral side wings 114A, 114B of the base member 110. Preferably an inner diameter of each outer sleeve 242A, 242B is substantially coterminous with an outer diameter of the corresponding inner sleeve 243A, 243B. It will be appreciated that the configuration of inner and outer sleeves may be reversed with the inner sleeve being movable and the outer sleeve stationary, provided the sleeves are movable relative to one another. The sleeves are slidable relative to one another but in alternative configurations they may be axially moveable relative to one another via any other suitable mechanism or configuration as described for the first embodiment.

The outer sleeves 242A, 242B are substantially axially aligned with corresponding inner sleeves 243A, 243B, and are linearly moveable along the common axis in directions A and B, between a fully retracted position and a fully extended position. The closed end of each outer sleeve 242A, 242B forms a support platform 240A, 240B configured to engage with the concrete slab in situ. In this manner, the support platform is moveable in the assembled state of the apparatus, between a fully retracted position shown in FIG. 14 in which locates substantially flush with the central plate 211 of the base member 210 and a fully extended position in which it is distant from the base member. Each support platform 240A, 240B comprises an exposed contact surface 241A, 241B configured to abut against the concrete slab in situ to support the slab thereon during the curing phase (as described for the first and second embodiments).

Figure 12:
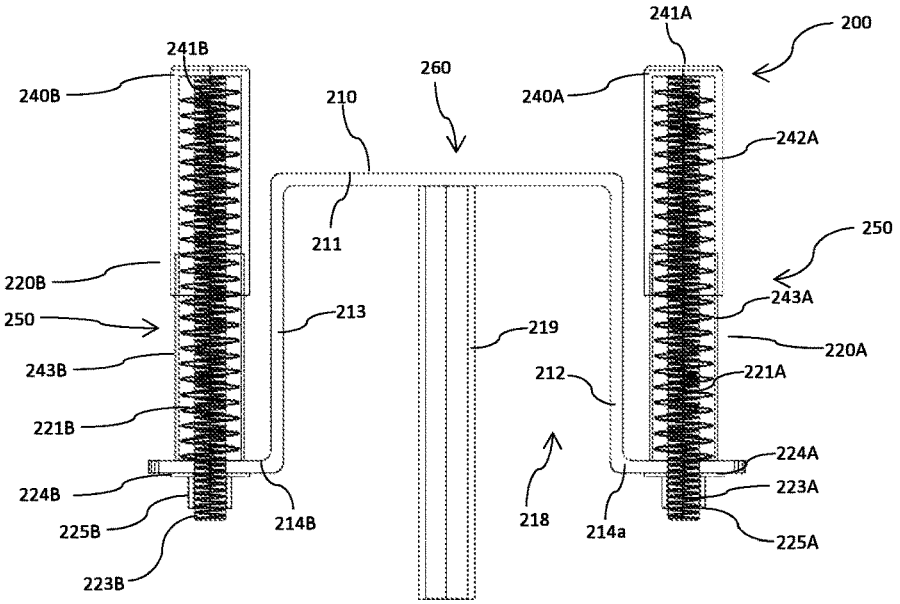
FIG. 12 is a front cross-sectional view of a third form support apparatus of the invention.
Figure 13:
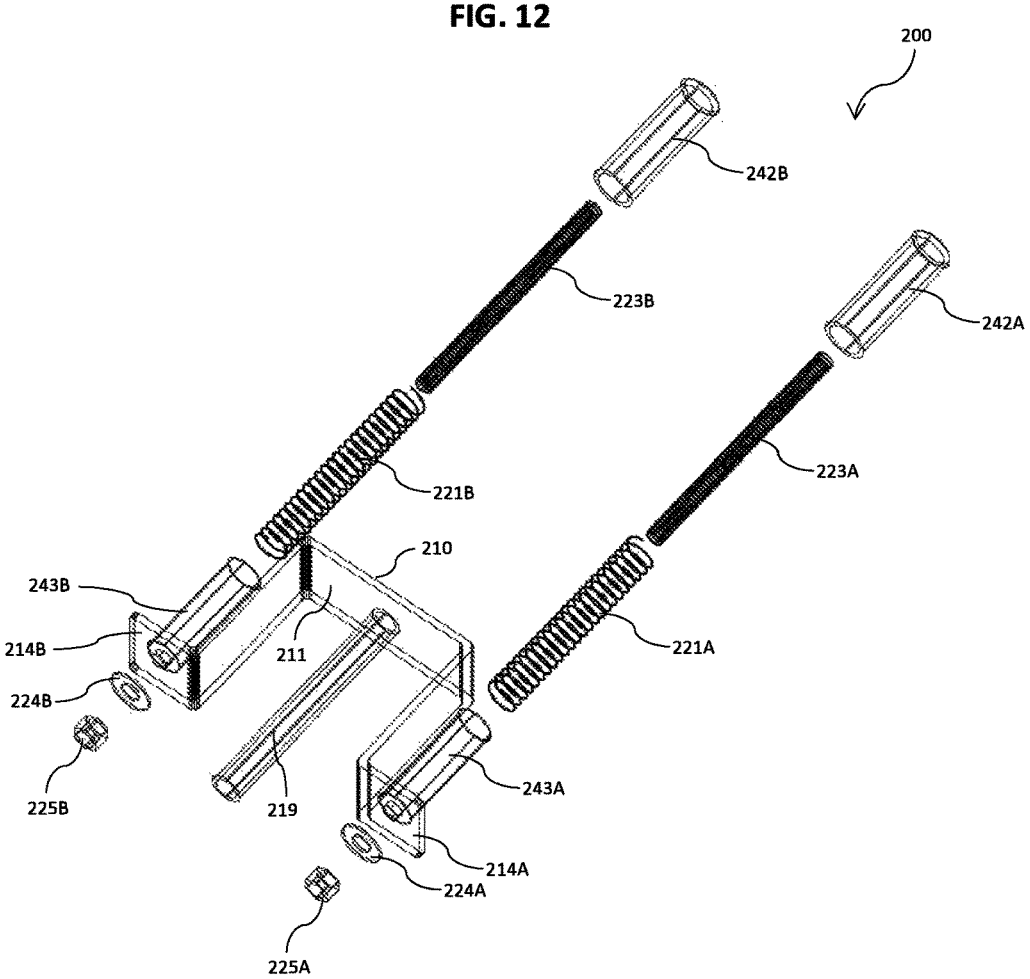
FIG. 13 is an exploded perspective view of the support apparatus of FIG. 12.

Each biased support mechanism 220A, 220B further comprises a central elongate rod or shaft 223A, 223B configured to extend through the corresponding biasing member 221A, 221B, and the inner 243A, 243B and outer sleeves 242A, 242B. The rod 223A, 223B of each mechanism 220A, 220B is fixedly coupled at one end to the corresponding support platform 240A, 240B and extends through corresponding aligned apertures in the inner sleeve 243A, 243B and lateral side wings 214A, 214B at the opposing end such that it is exposed. A washer 224A, 224B and corresponding fastener 225A, 225B is coupled to the exposed end of each rod 223A, 223B to provide a limiting stop or abutment. In this manner, the washer 224A, 224B of each mechanism acts as an abutment that limits the relative movement between the inner and outer sleeves by engaging the corresponding lateral side wall 214A, 214B of the base member when the outer sleeve and corresponding support platform 240A, 240B are moved to the fully extracted position as shown in FIGS. 12 and 15. In the retracted position the washer moves away from the lateral side walls as shown in FIG. 14.

Figure 14:
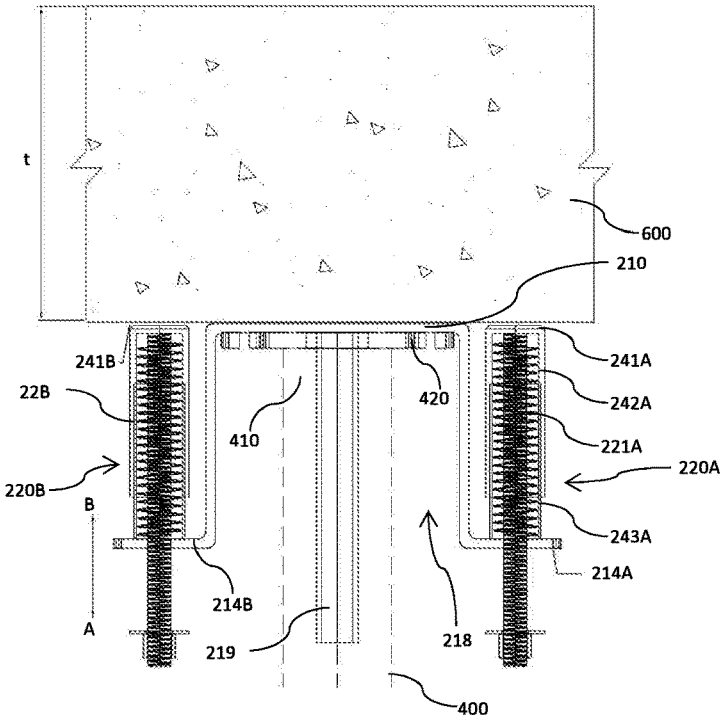
FIG. 14 is a front cross-section view of the support apparatus of FIG. 12 in use, supporting a concrete slab in an initial stage of curing.
Figure 15:
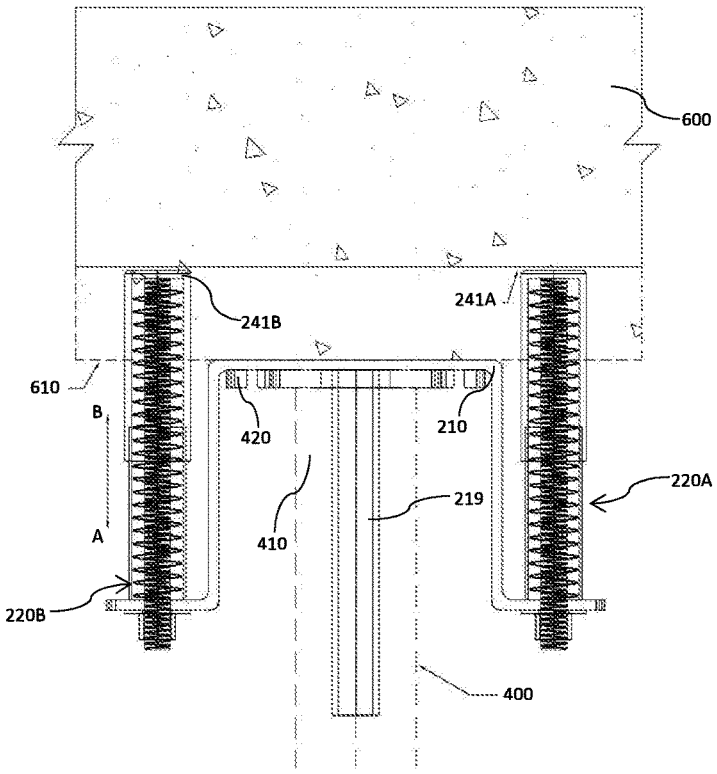
FIG. 15 is a front cross-section view of the support apparatus of FIG. 12 in use, supporting a concrete slab during or in the final stages of curing.

As mentioned, the apparatus 200 comprises a coupling mechanism 260 for coupling the biased support structure 250 to an end of a support prop 400 as shown in FIGS. 14 and 15. As for the first and second embodiments, the coupling mechanism comprises a base member 210 having a central plate 211 and side walls 212 and 213 extending from either side of the central plate to define a cavity 218 therebetween. The cavity is configured to receive a plate or platform 420 of a support prop 400 in situ. A coupling shaft 219 extends substantially orthogonally from a central portion of the plate 211 in a direction opposing the biased support mechanisms 220A, 220B. The shaft 219 is configured to be removably accommodated within an open end 410 of a support prop 400 in situ. The shaft is preferably of a sufficient length to ensure a stabilised connection between the apparatus 200 and the support prop 400.

As described for the first and second embodiments, it is preferred that the apparatus 200 is configured to releasably couple the support prop to allow for replacement and maintenance for example. In alternative embodiments other coupling mechanisms may be employed. For example, one or more fasteners may be utilised or a releasable clamping device may be provided by the mechanism which clamps against and/or about the end 410 of the prop support 400. Other releasable coupling mechanism that may be apparent to those skilled in the art are also possible and not intended to be excluded from the scope of this invention. It will be appreciated that in some embodiments, any combination of one or more coupling mechanisms as described above may be incorporated. In yet another alternative embodiment, the biased support structure 250 may be permanently coupled or otherwise integrally formed with the end 410 of a support prop 400.

Referring to FIG. 14, once assembled, the apparatus 200 can be installed on an end 410 of a support prop 400. To achieve this, the coupling shaft 219 is inserted into the hollow end 410 of the prop and the central plate 211 of the base member 210 is located to rest on the end plate 420 of the prop 400. The prop, with the apparatus installed, can then be positioned under the concrete slab to be supported such that the slab engages the support platform 240A, 240B of each support mechanism 220A, 220B, thereby forcing the support platforms 240A and 240B toward the fully retracted position as shown in FIG. 14. The springs 221A and 221B compress in this position and the outer sleeves 242A, 242B move in direction A over the inner sleeves 243A and 243B. The support platforms may lay flush with the central plate 211 of the main body in this position. Referring to FIG. 15, as the slab 600 cures, it contracts (i.e. the thickness t reduces) and moves away from the initial position 610 and away from the support prop 400. The apparatus 200, by action of the biasing springs 221A and 221B maintains support by biasing the support platforms 240A and 240B toward the fully extended position and toward the concrete slab, such that physical contact at location 620 between the support platforms 240A and 240B and the concrete slab is maintained. As such, even in the final stages of curing shown in FIG. 15, contact between the support structure and the concrete slab is maintained which ensures the prop remains in position, and the slab remains supported substantially during the entire curing phase.

In this embodiment the inner and outer sleeves of the support structure may be formed from a substantially rigid material, such as a stainless steel or a rigid plastics material. One or more liners may be provided on the contact surfaces 241A and 241B to soften the region of contact in some embodiments. In some configurations a single support plate may be coupled or integrally formed across both support mechanism 220A and 220B. In some embodiments, multiple biasing support mechanisms may be provided on each side of the apparatus 200.

Referring now to FIGS. 16-19 a fourth embodiment of a concrete support apparatus 300 of the invention is shown comprises a biased support structure 350 and a prop coupling mechanism 360. As with the third embodiment, in this embodiment the support structure comprises a pair of identical biased support mechanisms 320A, 320B located on either side of a base member 310 of the apparatus 300. The coupling mechanism is of a similar form to the mechanism 260 described in relation to the second embodiment, including a base member 310 having a central plate 311, a coupling cavity 318 and a coupling shaft 319. In this embodiment, however, the biased support mechanism 320A, 320B on each lateral wing 314A, 314B is different to that of the second embodiment. Each biased support mechanism comprises a biasing member 321A, 321B that is rigidly coupled at one end to the corresponding lateral side wing 31A, 314B. Each biasing member preferably extends substantially orthogonally therefrom. Each biased support mechanism further comprises a sleeve 343A, 343B extending laterally (and preferably orthogonally) from the side corresponding side wing 314A, 314B and within which at least a portion of the associated biasing member 321A, 321B resides. Each sleeve enables stabilisation of the associated biasing member to maintain movement substantially only within the tension and compression directions in situ, e.g. along axial directions A and B. In this embodiment, each biasing member is in the form of a compression spring 221A, 221B. Each spring is thus moveable between a relaxed or extended state/position shown in FIGS. 16 and 19 and a compressed position shown in FIG. 18.

In this embodiment, one end of each spring is preferably fixedly coupled to the base member, and most preferably to the corresponding wing of the base member. The opposing free end of each spring 321A, 321B is preferably capped by a cap member 340A, 340B. Each cap member is preferably fixedly coupled over at least the free end of the spring and forms a support platform by providing an external support surface 341A, 341B configured to engage and abut the concrete in situ. The external support surface of each cap preferably comprises a substantially planar profile to provide substantially consistent support. Furthermore, the surface may comprise one or more formations configured to improve frictional engagement between the surface and the concrete/support in situ. In this embodiment each cap is formed from a substantially soft material, such as a plastics material like Silicone, or rubber for example. Each cap is preferably sized such that at least a portion of the cap can be located within the corresponding sleeve of the associated support mechanism.

Figure 16:
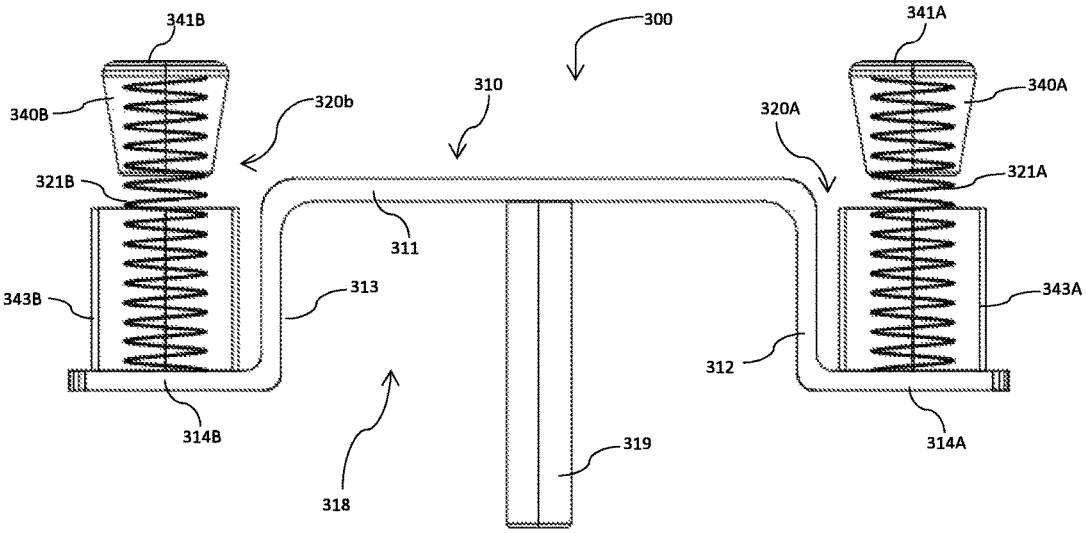
FIG. 16 is a front cross-sectional view of a fourth form support apparatus of the invention.
Figure 17:
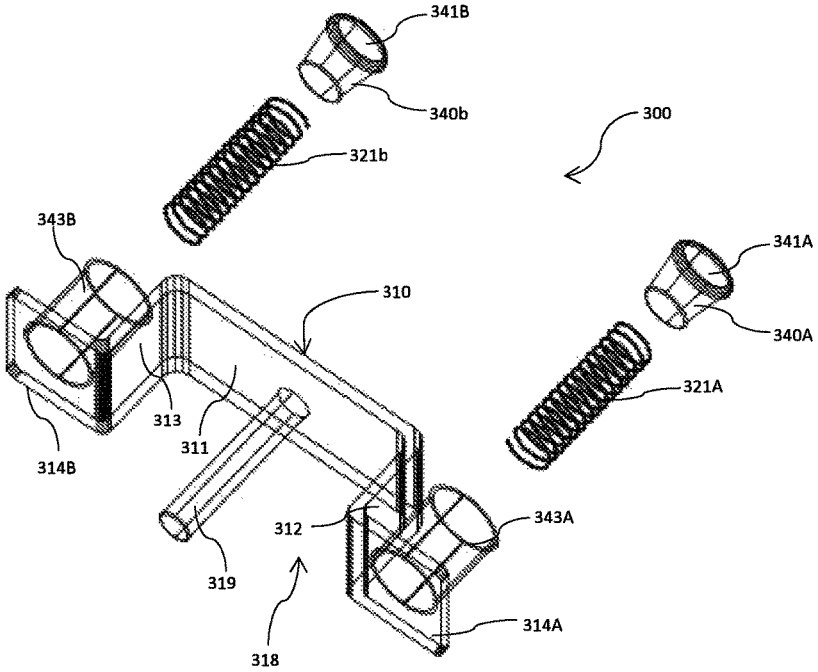
FIG. 17 is an exploded perspective view of the support apparatus of FIG. 16.
Figure 18:
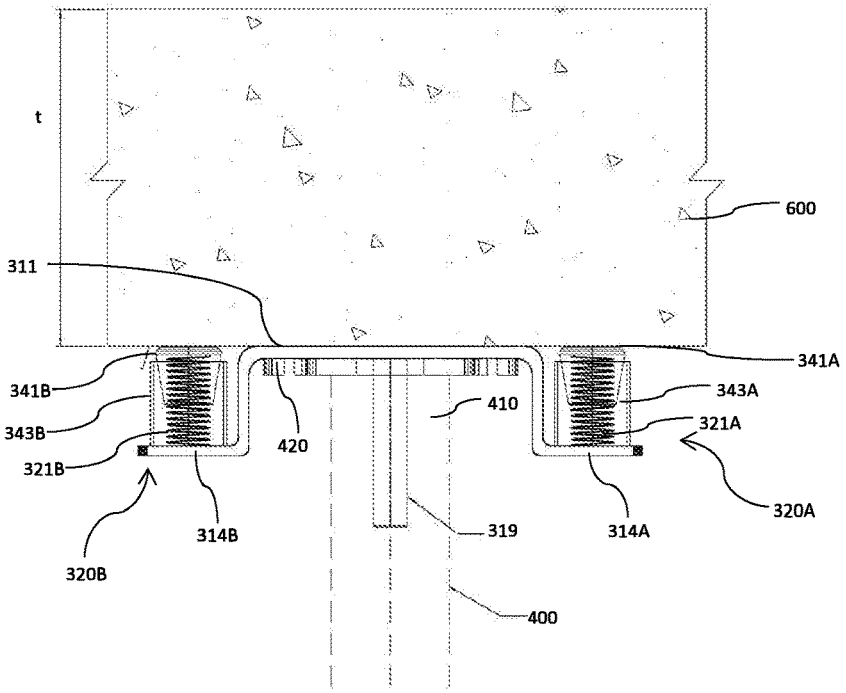
FIG. 18 is a front cross-section view of the support apparatus of FIG. 16 in use, supporting a concrete slab in an initial stage of curing.
Figure 19:
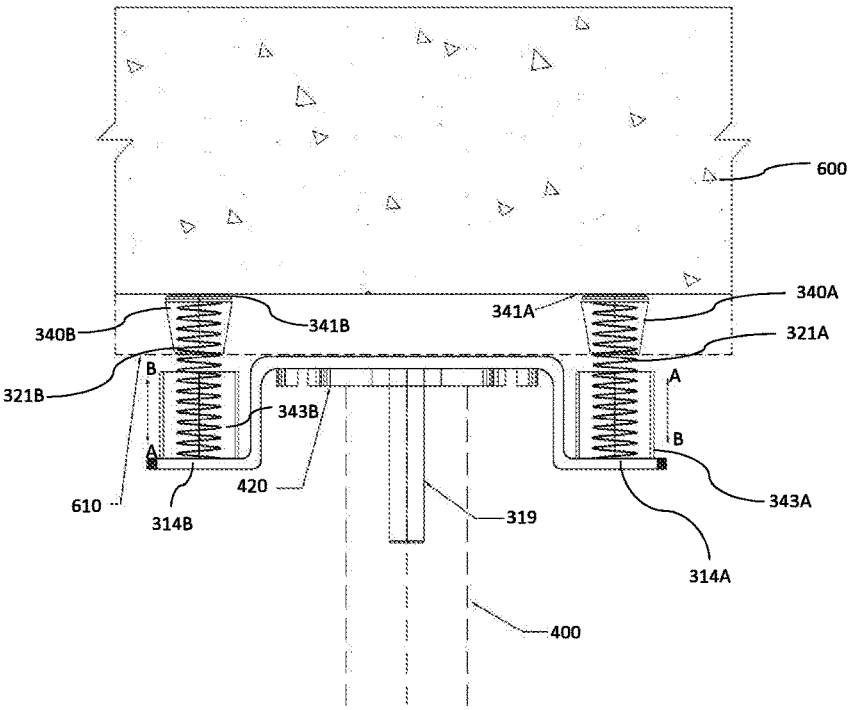
FIG. 19 is a front cross-section view of the support apparatus of FIG. 16 in use, supporting a concrete slab during or in the final stages of curing.

In this manner, each cap 340A, 340B and the associated support surface 341A, 341B, by action of the associated spring is linearly moveable along directions A and B, between a fully retracted position shown in FIG. 18 and a fully extended position shown in FIGS. 16 and 19. In the fully retracted position the support surface 341A, 341B of each cap locates substantially flush with the central plate 311 of the base member 310 and in the fully extended position each support surface is distant from the base member.

As mentioned, the apparatus 300 comprises a coupling mechanism 360 for coupling the biased support structure 350 to an end of a support prop 400 as shown in FIGS. 18 and 19. As for the third embodiment, the coupling mechanism comprises a base member 310 having a central plate 311 and side walls 312 and 313 extending from either side of the central plate to define a cavity 318 therebetween. The cavity is configured to receive a plate or platform 420 of a support prop 400 in situ. A coupling shaft 319 extends substantially orthogonally from a central portion of the plate 311 in a direction opposing the biased support mechanisms 320A, 320B. The shaft 319 is configured to be removably accommodated within an open end 410 of a support prop 400 in situ. The shaft is preferably of a sufficient length to ensure a stabilised connection between the apparatus 300 and the support prop 400.

As described for the previous embodiments, it is preferred that the apparatus 300 is configured to releasably couple the prop support to allow for replacement and maintenance for example. In alternative embodiments other coupling mechanisms may be employed as described for the first and second embodiments. In yet another alternative embodiment, the biased support structure 350 may be permanently coupled or otherwise integrally formed with the end 410 of a prop support 400.

Referring to FIG. 18, once assembled, the apparatus 300 can be installed on an end 410 of a support prop 400. To achieve this, the coupling shaft 319 is inserted into the hollow end 410 of the prop and the central plate 311 of the base member 310 is located to rest on the end plate 420 of the prop 400. The prop, with the apparatus installed, can then be positioned under the concrete slab to be supported such that the slab engages the support platform 340A, 340B of each support mechanism 320A, 320B, thereby forcing the support platforms 340A and 340B toward the fully retracted position as shown in FIG. 18. The springs 321A and 321B compress in this position. The support platforms may lay flush with the central plate 311 of the base member in this position. Referring to FIG. 19, as the slab 600 cures, it contracts (i.e. the thickness t reduces) and moves away from the initial position 610 and away from the support prop 400. The apparatus 300, by action of the biasing springs 321A and 321B maintains support by biasing the support platforms 340A and 340B toward the fully extended position and toward the concrete slab, such that physical contact at location 620 between the support platforms 340A and 340B and the concrete slab is maintained. As such, even in the final stages of curing shown in FIG. 19, contact between the support structure and the concrete slab is maintained which ensures the prop remains in position, and the slab remains supported substantially during the entire curing phase.

In some configurations a single support plate may be coupled or integrally formed across both support mechanism 320A and 2320B. In some embodiments, multiple similar biasing support mechanisms as described for this embodiment may be provided on each side of the apparatus 300.

It will be appreciated that for each of the above described embodiments, one or more biasing mechanisms may be either structurally or controllably biased. Examples of structurally biased mechanism include resilient members or magnetically biased constructions. These may continuously bias the support member toward the second position. Examples of controllably biased mechanisms include actuators that are electromagnetically, pneumatically or hydraulically operated and controlled, or any combination thereof. These may be operated to bias the support member toward the second position, only when the device is in situ for example and may also be operated to move the support member toward the first position when the device is initially installed. There may be any number of one or more types of biasing mechanisms necessary for achieving the desired level of support and biasing in any one of the embodiments of this invention.

Furthermore, in any one of the above embodiments, the support surface may comprise any profile necessary for providing sufficient support and frictional engagement with the concrete or formwork to be supported in situ. The support surface may comprise multiple surfaces or a single surface.

For any one of the above embodiments, the apparatus, including the base member, the sleeves and the support plate(s) are preferably formed from a substantially rigid material suited for the application of supporting concrete, such as steel. The helical spring may also be made from a substantially rigid material such as steel. Other materials may also be suitable for these parts and alternatively used as would be apparent to those skilled in the relative art.

The sleeves shown in each of the embodiments comprise a substantially cylindrical profile however it will be appreciated that other cross-sectional shapes may be used without departing from the scope of the invention.

It is envisaged that in some variations of the above described embodiments a releasable locking mechanism is provided which locks the biased support platform(s) in the retracted position to possibly reduce the effort required to install the device between the support prop and concrete slab for example. The mechanism can be released upon installation to allow the biased support platform to move toward the extracted position with the contracting concrete, in situ, as described above.

The foregoing description of the invention includes preferred forms thereof. Modifications may be made thereto without departing from the scope of the invention defined by the accompanying claims.

The invention claimed is:

1. An apparatus for use in construction to assist in the support of suspended concrete during at least a curing phase, the apparatus comprising:

a base member having a base plate configured to engage a corresponding support plate at an end of a support prop, in situ;

a support member operatively coupled to the base member and moveable relative to the base member between a first position and a second position;

a substantially hollow shaft extending substantially centrally relative to the base plate and on an opposing side of the base plate to the support member to extend within an opening of the end of the support prop, in situ;

a spring accommodated within the hollow shaft and operatively coupled to the support member to bias the support member toward the second position; and wherein, in situ, the support member assists in supporting suspended concrete by moving from the first position toward the second position as the concrete contracts to maintain substantially continuous support of the concrete during at least a substantial period of a curing phase of the suspended concrete.

2. An apparatus as claimed in claim 1 wherein the support member is linearly moveable relative to the base member between the first position and the second position.

3. An apparatus as claimed in claim 2 wherein the first position is a retracted position in which the support member is proximal to the base member and the second position is an extended position in which the support member is relatively distal to the base member.

4. An apparatus as claimed in claim 1 wherein compression of the spring causes the support member to move toward the first position and relaxation of the spring causes the support member to move toward the second position.

5. An apparatus as claimed in claim 1 wherein the support member comprises a support plate.

6. An apparatus as claimed in claim 1 wherein the base member is configured to releasably couple a support prop in situ.

7. An apparatus as claimed in claim 1 wherein the hollow shaft is coupled to and extends from the base plate.

8. An apparatus as claimed in claim 1 wherein the base member is axially moveable over a central axial rod of the support member.

9. An apparatus as claimed in claim 8 wherein the spring is coupled about the central axial rod and held in compression with one end against the support member and an opposing end against the base member.

10. An apparatus as claimed in claim 9 wherein the central axial rod extends within the hollow shaft.

11. An apparatus as claimed in claim 1 further comprising a guide mechanism configured to maintain axial alignment of the support member and the base member along a common axis during operation of the apparatus.

12. An apparatus as claimed in claim 11 wherein the support member comprises a central support plate and side plates extending laterally from the central support plate, the base member comprises side plates extending laterally from the base plate, the guide mechanism comprises of a pair of guide ribs formed on either the lateral side plates of the support member or the lateral side plates of the base member and a corresponding pair of guide channels formed on the other of the lateral side plates of the support member or the lateral side plates of the base member, and wherein the guide ribs are accommodated within the guide grooves to maintain axial alignment during movement of the support member relative to the base member.

13. An apparatus as claimed in claim 1 wherein the base member further comprises one or more anchoring points and the apparatus further comprises an anchoring device configured to anchor the base member to a support prop in situ via the one or more anchoring points.

14. An apparatus as claimed in claim 1 wherein the base member further comprises a pair of opposed side walls extending laterally from either side of the base plate.

15. An apparatus as claimed in claim 1 wherein the hollow shaft is of sufficient length to remain within the open end of the support prop, in situ, when the support member is in the first position and when the support member is in the second position.

16. An apparatus as claimed in claim 1 wherein the hollow shaft extends substantially orthogonally relative to the base plate.

17. An apparatus as claimed in claim 5 wherein the support plate comprises a plurality of gripping formations on a support surface configured to engage the suspended concrete to thereby enhance frictional engagement, in situ.

18. An apparatus as claimed in claim 11 wherein the guide mechanism substantially inhibits relative rotational movement about the common axis between the support member and the base member.

19. A system for supporting suspended concrete in construction during at least a curing phase of the concrete in which the concrete typically contracts, the system comprising:

a support prop having a base end and a support end; and a support apparatus coupled to either the base end or the support end of the support prop and having:

a base plate coupled to the respective base end or support end of the support prop;

a support member operatively coupled to the base plate and moveable relative to the base member between a first position and a second position;

a substantially hollow shaft extending substantially centrally relative to the base plate and on an opposing side of the base plate to the support member to extend within an opening of the respective base end or support end of the support prop, in situ;

a spring accommodated within the hollow shaft and operatively coupled to the support member to bias the support member toward the second position; and wherein the support member assists in supporting suspended concrete by moving from the first position toward the second position as the concrete contracts to maintain substantially continuous support of the concrete during at least a substantial period of a curing phase of the concrete.

20. A system as claimed in claim 19 wherein the support apparatus is coupled to the base end of the support prop configured to locate distal to suspended concrete, in situ.

21. A system as claimed claim 19 wherein the support apparatus is coupled to the support end of the support prop configured to locate adjacent suspended concrete, in situ.

* * * * *